US009892680B2

(12) United States Patent
Sato et al.

(10) Patent No.: US 9,892,680 B2
(45) Date of Patent: Feb. 13, 2018

(54) DISPLAY DEVICE HAVING DISPLAY CELLS CAPABLE OF BEING INDEPENDENTLY DRIVEN

(71) Applicant: Japan Display Inc., Tokyo (JP)

(72) Inventors: Toshihiro Sato, Tokyo (JP); Hajime Akimoto, Tokyo (JP)

(73) Assignee: Japan Display Inc., Tokyo (JP)

( * ) Notice: Subject to any disclaimer, the term of this patent is extended or adjusted under 35 U.S.C. 154(b) by 75 days.

(21) Appl. No.: 14/736,954

(22) Filed: Jun. 11, 2015

(65) Prior Publication Data

US 2015/0364075 A1 Dec. 17, 2015

(30) Foreign Application Priority Data

Jun. 12, 2014 (JP) ..... 2014-121885

(51) Int. Cl.
*G09G 3/3233* (2016.01)
*G09G 3/00* (2006.01)

(52) U.S. Cl.
CPC ..... *G09G 3/3233* (2013.01); *G09G 3/007* (2013.01); *G09G 2300/0452* (2013.01)

(58) Field of Classification Search
None
See application file for complete search history.

(56) References Cited

U.S. PATENT DOCUMENTS

2003/0025708 A1* 2/2003 Irie ..... G09G 3/2003 345/589
2003/0067426 A1* 4/2003 Awamoto ..... G09G 3/2983 345/72
2003/0174151 A1* 9/2003 Awamoto ..... G09G 3/2983 345/690
2005/0151752 A1* 7/2005 Phan ..... G09G 3/2003 345/589
2006/0038953 A1* 2/2006 Moriya ..... G02F 1/133514 349/144
2007/0211000 A1* 9/2007 Itoh ..... G09G 3/2025 345/83
2011/0279493 A1* 11/2011 Phan ..... H04N 9/30 345/694

(Continued)

FOREIGN PATENT DOCUMENTS

JP 2002-215082 A 7/2002
JP 2003-259253 A 9/2003
JP 2007-240873 A 9/2007

*Primary Examiner* — David D Davis
(74) *Attorney, Agent, or Firm* — Typha IP LLC

(57) ABSTRACT

Disclosed is a display device capable of achieving a high definition imaging without depending on micronization of display cells. The display device includes: a display panel in which display cells capable of being independently driven are two-dimensionally arranged; and a drive circuit that decomposes an original image that includes plural pixels into plural sub-sampling images that include the pixels which are respectively intermittent in a row direction and a column direction, and sequentially displays the plural sub-sampling images on the display panel. The drive circuit drives a display cell group including plural display cells that are two-dimensionally arranged to be adjacent to each other, corresponding to the respective pixels. The display cell groups respectively corresponding to two arbitrary sub-sampling images are overlapped and are disposed to be mutually shifted.

1 Claim, 30 Drawing Sheets

(56) References Cited

U.S. PATENT DOCUMENTS

2013/0286262 A1* 10/2013 Hayashi ..... H04N 9/045
348/280
2014/0104301 A1* 4/2014 Nakagawa ..... G09G 3/2003
345/589

* cited by examiner

FIG.5

200

| | | | | | |
|---|---|---|---|---|---|
| P(1,1) | P(1,2) | P(1,3) | P(1,4) | P(1,5) | P(1,6) |
| P(2,1) | P(2,2) | P(2,3) | P(2,4) | P(2,5) | P(2,6) |
| P(3,1) | P(3,2) | P(3,3) | P(3,4) | P(3,5) | P(3,6) |
| P(4,1) | P(4,2) | P(4,3) | P(4,4) | P(4,5) | P(4,6) |
| P(5,1) | P(5,2) | P(5,3) | P(5,4) | P(5,5) | P(5,6) |
| P(6,1) | P(6,2) | P(6,3) | P(6,4) | P(6,5) | P(6,6) |

RELATED ART

FIG.11

4

| | | | | | | |
|---|---|---|---|---|---|---|
| R | G | B | W | R | G | B |
| B | W | R | G | B | W | R |
| R | G | B | W | R | G | B |
| B | W | R | G | B | W | R |
| R | G | B | W | R | G | B |
| B | W | R | G | B | W | R |
| R | G | B | W | R | G | B |

FIG.12

4

R=1 2 3 4 .....

| | | | | | | | | | | | | | |
|---|---|---|---|---|---|---|---|---|---|---|---|---|---|
| L=1 | G | R | G | B | G | R | G | B | G | R | G | B | G | R |
| 2 | G | B | G | R | G | B | G | R | G | B | G | R | G | B |
| 3 | G | R | G | B | G | R | G | B | G | R | G | B | G | R |
| 4 | G | B | G | R | G | B | G | R | G | B | G | R | G | B |
| ⋮ | G | R | G | B | G | R | G | B | G | R | G | B | G | R |
| ⋮ | G | B | G | R | G | B | G | R | G | B | G | R | G | B |
| ⋮ | G | R | G | B | G | R | G | B | G | R | G | B | G | R |

FIG.14

4

R=1 2 3 4 .....

| | | | | | | | | | | | | | |
|---|---|---|---|---|---|---|---|---|---|---|---|---|---|
| L=1 | G | R | G | B | G | R | G | B | G | R | G | B | G | R |
| 2 | W | B | G | R | W | B | G | R | W | B | G | R | W | B |
| 3 | G | R | G | B | G | R | G | B | G | R | G | B | G | R |
| 4 | W | B | G | R | W | B | G | R | W | B | G | R | W | B |
| ⋮ | G | R | G | B | G | R | G | B | G | R | G | B | G | R |
| ⋮ | W | B | G | R | W | B | G | R | W | B | G | R | W | B |
| ⋮ | G | R | G | B | G | R | G | B | G | R | G | B | G | R |

FIG.15

4

| | R=1 | 2 | 3 | 4 | ..... | | | | | | | | | |
|---|---|---|---|---|---|---|---|---|---|---|---|---|---|---|
| L=1 | G | R | W | B | G | R | W | B | G | R | W | B | G | R |
| 2 | W | B | G | R | W | B | G | R | W | B | G | R | W | B |
| 3 | G | R | W | B | G | R | W | B | G | R | W | B | G | R |
| 4 | W | B | G | R | W | B | G | R | W | B | G | R | W | B |
| ⋮ | G | R | W | B | G | R | W | B | G | R | W | B | G | R |
| ⋮ | W | B | G | R | W | B | G | R | W | B | G | R | W | B |
| ⋮ | G | R | W | B | G | R | W | B | G | R | W | B | G | R |

DISPLAY DEVICE HAVING DISPLAY CELLS CAPABLE OF BEING INDEPENDENTLY DRIVEN

CROSS-REFERENCE TO RELATED APPLICATION

The present application claims priority from Japanese application JP2014-121885 filed on Jun. 12, 2014, the content of which is hereby incorporated by reference into this application.

BACKGROUND OF THE INVENTION

1. Field of the Invention

The present invention relates to a display device having a display panel in which display cells capable of being independently driven are two-dimensionally arranged.

2. Description of the Related Art

A display device such as an organic electroluminescence (EL) display device or a liquid crystal display device forms an image by plural pixels (display cells) which are two-dimensionally arranged. In the related art, image definition enhancement has been achieved by making pixels fine.

SUMMARY OF THE INVENTION

In the related art, micro-processing of display cells has been necessary according to image definition enhancement, which causes problems in formation of the display cells. Further, since an opening area of a pixel is reduced according to the image definition enhancement, in a liquid crystal display device, the intensity of the light that passes through a display cell is reduced, and in an organic EL display device, a light emitting area of a display cell is reduced, both of which lead to reduction in the luminance of an image. By increasing the intensity of light emitted from a backlight, or by increasing power supplied to an organic light-emitting diode (OLED), it is possible to increase luminance and to obtain necessary brightness for displaying an image. However, this method causes an increase in power consumption.

The invention provides a display device capable of achieving high definition imaging without depending on micronization of display cells.

(1) According to an aspect of the invention, there is provided a display device including: a display panel in which display cells capable of being independently driven are two-dimensionally arranged; and a drive circuit that decomposes an original image that includes a plurality of pixels into a plurality of sub-sampling images that includes the pixels which are respectively intermittent in a row direction and a column direction, and sequentially displays the plurality of sub-sampling images on the display panel, in which the drive circuit drives a display cell group including a plurality of display cells that are two-dimensionally arranged to be adjacent to each other, corresponding to the respective pixels, and the display cell group corresponding to an arbitrary attention pixel in one sub-sampling image among two arbitrary sub-sampling images that form one original image and the display cell group corresponding to a pixel adjacent to the attention pixel in the other sub-sampling image are overlapped and are disposed to be mutually shifted.

(2) In the display device according to (1), the display panel may include four types of display cells having different light emitting colors, which are arranged in a matrix form, and the four types of display cells are arranged so that two types of display cells are alternately arranged in the row direction in each of an odd row and an even row, or are arranged so that two types of display cells are alternately arranged in the column direction in each of the odd column and the even column; the drive circuit decomposes the original image into four sub-sampling images of a first sub-sampling image that includes the pixels in the odd rows and the odd columns, a second sub-sampling image that includes the pixels in the even rows and the odd columns, a third sub-sampling image that includes the pixels in the even rows and the even columns, and a fourth sub-sampling image that includes the pixels in the odd rows and the even columns; and the display cell group includes four display cells that are arranged in two rows and two columns, in which with respect to the display cell groups corresponding to the pixels of the first sub-sampling image, the display cell groups corresponding to the pixels of the second sub-sampling image are shifted by one cell in the column direction, the display cell groups corresponding to the pixels of the third sub-sampling image are shifted by one cell in the column direction and the row direction, respectively, and the display cell groups corresponding to the pixels of the fourth sub-sampling image are shifted by one cell in the row direction.

(3) In the display device according to (1), the display panel may include three types of display cells having different light emitting colors, which are arranged in a matrix form, in which a column in which a first type of display cell and a second type of display cell are alternately arranged in every cell and a column in which a third type of display cells are arranged in a stripe form are alternately arranged in the row direction, and the first type of display cell and the second type of display cell are alternately arranged in every other cell in each row of the display cells; the drive circuit may decompose the original image into four sub-sampling images of a first sub-sampling image that includes the pixels in the odd rows and the odd columns, a second sub-sampling image that includes the pixels in the even rows and the odd columns, a third sub-sampling image that includes the pixels in the even rows and the even columns, and a fourth sub-sampling image that includes the pixels in the odd rows and the even columns; and the display cell group may include eight display cells that are arranged in two rows and four columns, in which with respect to the display cell groups corresponding to the pixels of the first sub-sampling image, the display cell groups corresponding to the pixels of the second sub-sampling image are shifted by one cell in the column direction, the display cell groups corresponding to the pixels of the third sub-sampling image are shifted by one cell in the column direction and by two cells in the row direction, and the display cell groups corresponding to the pixels of the fourth sub-sampling image are shifted by two cells in the row direction.

(4) In the display device according to (1), the display panel may include three types of display cells having different light emitting colors, which are arranged in a matrix form, in which a column in which a first type of display cell and a second type of display cell are alternately arranged in every cell and a column in which a third type of display cells are arranged in a stripe form are alternately arranged in a row direction, and the first type of display cell and the second type of display cell are alternately arranged in every other cell in each row of the display cells; the drive circuit may decompose the original image into four sub-sampling images of a first sub-sampling image that includes the pixels in the odd rows and the odd columns, a second sub-sampling image that includes the pixels in the even rows and the odd columns, a third sub-sampling image that includes the pixels in the even rows and the even columns, and a fourth sub-sampling image that includes the pixels in the odd rows and the even columns; and the display cell group may include four display cells that are arranged in two rows and two columns, in which with respect to the display cell groups corresponding to the pixels of the first sub-sampling image, the display cell groups corresponding to the pixels of the second sub-sampling image are shifted by one cell in the column direction, the display cell groups corresponding to the pixels of the third sub-sampling image are shifted by one cell in the column direction and by one cell in the row direction, and the display cell groups corresponding to the pixels of the fourth sub-sampling image are shifted by one cell in the row direction.

(5) In the display device according to (3) or (4), the display panel may have a configuration in which one of the third type of four display cells that are arranged in two columns, with one arbitrary column in which the first and second types of display cells interposed therebetween are arranged, in two adjacent arbitrary rows, is replaced with a fourth type of display cell having a light emitting color different from those of the first to third types of display cells.

(6) In the display device according to (3) or (4), the display panel may have a configuration in which two display cells which are arranged in a diagonal direction among the third type of four display cells that are arranged in two columns, with one arbitrary column in which the first and second types of display cells interposed therebetween are arranged, in two adjacent arbitrary rows, are replaced with a fourth type of display cells having a light emitting color different from those of the first to third types of display cells.

(7) In the display device according to (1), the display panel may have three types of display cells having different light emitting colors, in which grid points of a first rectangular grid correspond to positions of the display cells in the even rows and positions of the display cells in the even columns, gridpoints of a second rectangular grid that is shifted in the row direction and the column direction with respect to the first rectangular grid correspond to positions of the display cells in the odd rows and positions of the display cells in the odd columns, first and second types of display cells are alternately arranged in the row direction and the column direction at the grid points of the first rectangular grid, and a third type of display cell is arranged in each grid point of the second rectangular grid; the drive circuit may decompose the original image into four sub-sampling images of a first sub-sampling image that includes the pixels in the odd rows and the odd columns, a second sub-sampling image that includes the pixels in the even rows and the odd columns, a third sub-sampling image that includes the pixels in the even rows and the even columns, and a fourth sub-sampling image that includes the pixels in the odd rows and the even columns; and the display cell group may include eight display cells that are arranged in four rows and four columns, in which with respect to the display cell groups corresponding to the pixels of the first sub-sampling image, the display cell groups corresponding to the pixels of the second sub-sampling image are shifted by two rows, the display cell groups corresponding to the pixels of the third sub-sampling image are shifted by two rows and two columns, and the display cell groups corresponding to the pixels of the fourth sub-sampling image are shifted by two columns.

(8) In the display device according to (1), the display panel may have three types of display cells having different light emitting colors, in which grid points of a first rectangular grid correspond to positions of the display cells in the even rows and positions of the display cells in the even columns, gridpoints of a second rectangular grid that is shifted in the row direction and the column direction with respect to the first rectangular grid correspond to positions of the display cells in the odd rows and positions of the display cells in the odd columns, first and second types of display cells are alternately arranged in the row direction and the column direction at the grid points of the first rectangular grid, and a third type of display cell is arranged in each grid point of the second rectangular grid; the drive circuit may decompose the original image into four sub-sampling images of a first sub-sampling image that includes the pixels in the odd rows and the odd columns, a second sub-sampling image that includes the pixels in the even rows and the odd columns, a third sub-sampling image that includes the pixels in the even rows and the even columns, and a fourth sub-sampling image that includes the pixels in the odd rows and the even columns; and the display cell group may include four display cells that are arranged in four rows and two columns, in which with respect to the display cell groups corresponding to the pixels of the first sub-sampling image, the display cell groups corresponding to the pixels of the second sub-sampling image are shifted by two rows, the display cell groups corresponding to the pixels of the third sub-sampling image are shifted by two rows and one column, and the display cell groups corresponding to the pixels of the fourth sub-sampling image are shifted by one column.

(9) In the display device according to (1), the display panel may have three types of display cells having different light emitting colors, in which grid points of a first rectangular grid correspond to positions of the display cells in the even rows and positions of the display cells in the even columns, gridpoints of a second rectangular grid that is shifted in the row direction and the column direction with respect to the first rectangular grid correspond to positions of the display cells in the odd rows and positions of the display cells in the odd columns, first and second types of display cells are alternately arranged in the row direction and the column direction at the grid points of the first rectangular grid, and a third type of display cell is arranged in each grid point of the second rectangular grid; the drive circuit may decompose the original image into four sub-sampling images of a first sub-sampling image that includes the pixels in the odd rows and the odd columns, a second sub-sampling image that includes the pixels in the even rows and the odd columns, a third sub-sampling image that includes the pixels in the even rows and the even columns, and a fourth sub-sampling image that includes the pixels in the odd rows and the even columns; and the display cell group may be a pair of display cells that includes a central display cell disposed on a grid point of the first rectangular grid and a selective display cell disposed on any one of four grid points of the second rectangular grid in the vicinity of the central display cell, in which with respect to the display cell pair corresponding to the pixels of the first sub-sampling image, a relative position of the selective display cell with respect to the central display cell is reversed in the column direction in the display cell pair corresponding to the pixels of the second sub-sampling image, is reversed in the row direction and the column direction in the display cell pair corresponding to the pixels of the third sub-sampling image, and is reversed in the row direction in the display cell pair corresponding to the pixels of the fourth sub-sampling image.

(10) In the display device according to any one of (7) to (9), the display panel may have a configuration in which one of the third type of four arbitrary display cells that are arranged in two rows and two columns in the second rectangular grid is replaced with a fourth type of display cell having a light emitting color different from those of the first to third types of display cells.

(11) In the display device according to any one of (7) to (9), the display panel may have a configuration in which two display cells which are arranged in a diagonal direction among the third type of four arbitrary display cells that are arranged in two rows and two columns in the second rectangular grid are replaced with a fourth type of display cells having a light emitting color different from those of the first to third types of display cells.

(12) In the display device according to (1), the display panel may have a stripe arrangement in which three types of display cells having different light emitting colors are periodically arranged in the row direction and the same type of display cells are arranged in the column direction; the drive circuit may decompose the original image into four sub-sampling images of a first sub-sampling image that includes the pixels in the odd rows and the odd columns, a second sub-sampling image that includes the pixels in the even rows and the odd columns, a third sub-sampling image that includes the pixels in the even rows and the even columns, and a fourth sub-sampling image that includes the pixels in the odd rows and the even columns; and the display cell group may include six display cells that are arranged in two rows and three columns, in which with respect to the display cell groups corresponding to the pixels of the first sub-sampling image, the display cell groups corresponding to the pixels of the second sub-sampling image are shifted by one cell in the column direction, the display cell groups corresponding to the pixels of the third sub-sampling image are shifted by one cell in the column direction and by k cells (k is 1 or 2) in the row direction, and the display cell groups corresponding to the pixels of the fourth sub-sampling image are shifted by the k cells in the row direction.

(13) In the display device according to (1), the display panel may have a stripe arrangement in which three types of display cells having different light emitting colors are periodically arranged in the row direction and the same type of display cells are arranged in the column direction; the drive circuit may decompose the original image into six sub-sampling images of a first sub-sampling image including pixels of a (2n−1)-th row and a (3m−2)-th column (n and m are natural numbers), a second sub-sampling image including pixels of a 2n-th row and the (3m−2)-th column, a third sub-sampling image including pixels of the 2n-th row and a (3m−1)-th column, a fourth sub-sampling image including pixels of the 2n-th row and a 3m-th column, a fifth sub-sampling image including pixels of the (2n−1)-th row and the 3m-th column, and a sixth sub-sampling image including pixels of the (2n−1)-th row and the (3m−1)-th column; and the display cell group may include six display cells that are arranged in two rows and three columns, in which the display cell groups corresponding to the pixels of the second sub-sampling image are shifted by one cell in the column direction with respect to the display cell groups corresponding to the pixels of the first sub-sampling image, the display cell groups corresponding to the pixels of the third and fourth sub-sampling images are respectively shifted by one cell and two cells in the column direction where a column number increases in the original image with respect to the display cell groups corresponding to the pixels of the second sub-sampling image, and the display cell groups corresponding to the pixels of the sixth and fifth sub-sampling images are respectively shifted by one cell and two cells in the column direction where the column number increases in the original image with respect to the display cell groups corresponding to the pixels of the first sub-sampling image.

(14) In the display device according to (1), the display panel may have a staggered arrangement in which positions of the display cells arranged in the row direction are shifted between the odd row and the even row and first to third types of display cells having different light emitting colors are periodically arranged in a staggered arrangement in the odd row and the even row which are adjacent to each other; the drive circuit may decompose the original image into four sub-sampling images of a first sub-sampling image including pixels of a (2n−1)-th row and a (2m−1)-th column (n and m are natural numbers), a second sub-sampling image including pixels of a 2n-th row and the (2m−1)-th column, a third sub-sampling image including pixels of the 2n-th row and a 2m-th column, and a fourth sub-sampling image including pixels of the (2n−1)-th row and the 2m-th column; and the display cell group includes six display cells of which positions in the row direction are continuous in a staggered arrangement in two adjacent rows, in which when the display cell group corresponding to the pixels of the first sub-sampling image is set to a j-th display cell to a (j+5)-th display cell (j is a natural number) in the row direction in the staggered arrangement in a (2k−1)-th row and a 2k-th row (k is a natural number), the display cell group corresponding to the pixels of the second sub-sampling image includes a j-th display cell to a (j+5)-th display cell in the row direction in the staggered arrangement in the 2k-th row and a (2k+1)-th row, the display cell group corresponding to the pixels of the third sub-sampling image includes a (j+3)-th display cell to a (j+8)-th display cell in the row direction in the staggered arrangement in the 2k-th row and the (2k+1)-th row, and the display cell group corresponding to the pixels of the fourth sub-sampling image includes a (j+3)-th display cell to a (j+8)-th display cell in the row direction in the staggered arrangement in the (2k−1)-th row and the 2k-th row.

(15) In the display device according to any one of (2) to (4), (7) to (9), and (12) to (14), the drive circuit may sequentially display the plurality of sub-sampling images obtained by decomposing the original image on the display panel in a circulating order according to an ascending or descending order of ordinal numbers attached to the sub-sampling images from any one of the sub-sampling images.

(16) In the display device according to (1), the display panel may have a stripe arrangement in which three types of display cells having different light emitting colors are periodically arranged in the row direction and the same type of display cells are arranged in the column direction; the drive circuit may decompose the original image into nine sub-sampling images of a first sub-sampling image including pixels of a (3n−2)-th row and a (3m−2)-th column (n and m are natural numbers), a second sub-sampling image including pixels of a (3n−1)-th row and the (3m−2)-th column, a third sub-sampling image including pixels of a 3n-th row and the (3m−2)-th column, a fourth sub-sampling image including pixels of the (3n−2)-th row and a (3m−1)-th column, a fifth sub-sampling image including pixels of the (3n−1)-th row and the (3m−1)-th column, and a sixth sub-sampling image including pixels of the 3n-th row and the (3m−1)-th column, a seventh sub-sampling image including pixels of the (3n−2)-th row and a 3m-th column, an eighth sub-sampling image including pixels of the (3n−1)-th row and the 3m-th column, and a ninth sub-sampling image including pixels of the 3n-th row and the 3m-th column; and the display cell group may include nine display cells that are arranged in three rows and three columns, in which the display cell groups corresponding to the pixels of the second and third sub-sampling images are respectively shifted by one cell and two cells in the column direction where a column number increases in the original image with respect to the display cell group corresponding to the pixels of the first sub-sampling image, the display cell groups corresponding to the pixels of the fourth to sixth sub-sampling images are respectively shifted by one cell in the row direction where a row number increases in the original image with respect to the display cell groups corresponding to the pixels of the first to third sub-sampling images, and the display cell groups corresponding to the pixels of the seventh to ninth sub-sampling images are respectively shifted by two cells in the row direction where the row number increases in the original image with respect to the display cell groups corresponding to the pixels of the first to third sub-sampling images.

BRIEF DESCRIPTION OF THE DRAWINGS

FIG. 5 is a schematic diagram illustrating an original image of one frame displayed on a display panel.

FIG. 11 is a schematic plan view illustrating an example of another arrangement of the display cells in the pixel array section according to the first exemplary embodiment of the invention.

FIG. 12 is a schematic plan view illustrating an arrangement of display cells in a pixel array section according to a second exemplary embodiment of the invention.

FIG. 14 is a schematic plan view illustrating an arrangement of display cells of a pixel array section according to a second modification example of the second exemplary embodiment of the invention.

FIG. 15 is a schematic plan view illustrating an arrangement of display cells of a pixel array section according to a third modification example of the second exemplary embodiment of the invention.

DETAILED DESCRIPTION OF THE INVENTION

Figure 1:
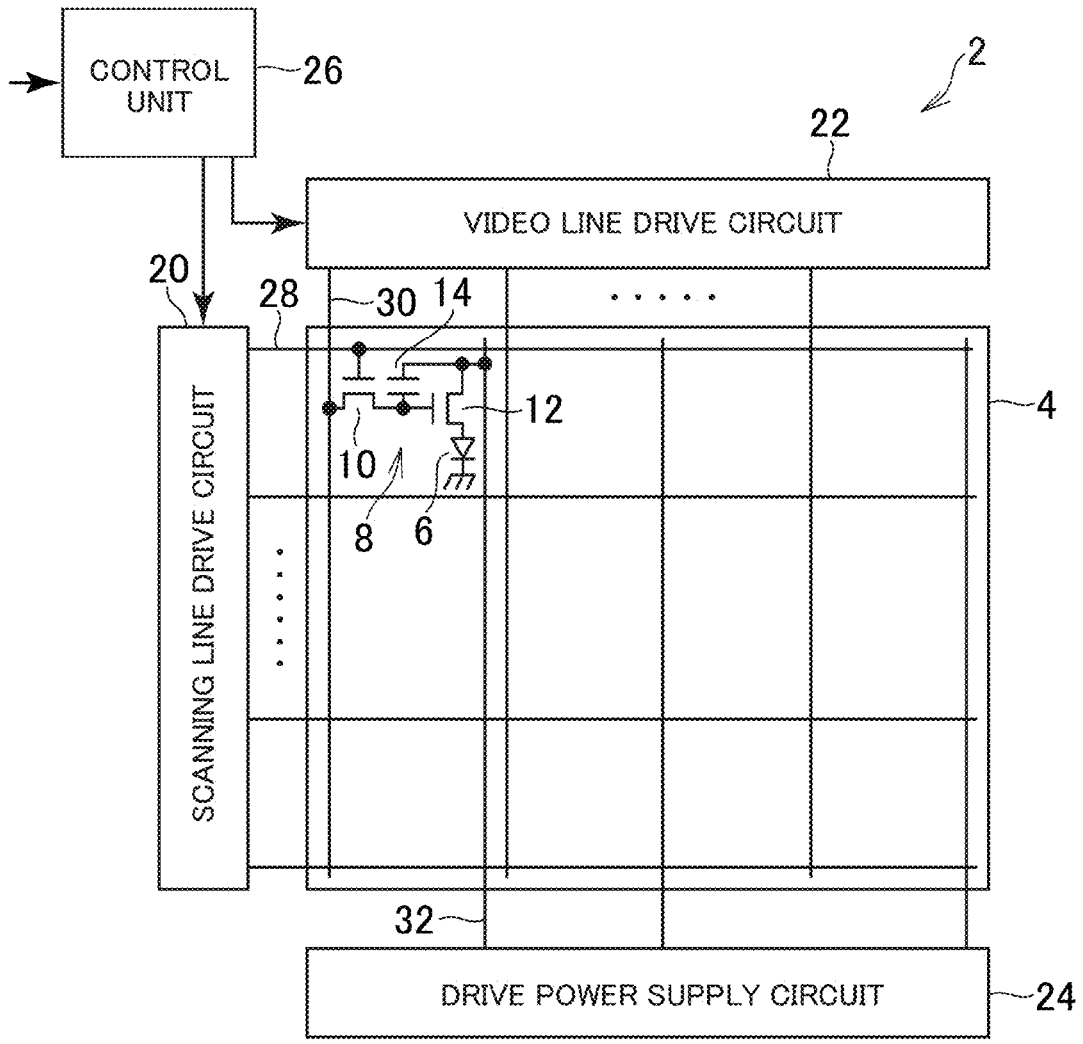
FIG. 1 is a schematic diagram illustrating a configuration of an outline of an organic EL display device according to a first exemplary embodiment of the invention.

Hereinafter, exemplary embodiments of the invention will be described with reference to the accompanying drawings.

The described embodiments are only exemplary, and thus, it is obvious by those skilled in the art that various modifications may be made in a range without departing from the concept of the invention. Such modifications are also included in the scope of the invention. Further, for more clarification of description, drawings may be schematically shown with respect to widths, thicknesses, shapes or the like of respective sections, compared with actual aspects, but they are examples and do not limit interpretation of the invention. In addition, in the present specification and respective drawings, the same reference numerals are given to the same components as described in the drawings, and detailed description thereof will not be repeated as necessary.

A display device according to the exemplary embodiments of the invention is an organic EL display device. The organic EL display device is an active matrix type display device, and is mounted in a television, a personal computer, a mobile terminal, a mobile phone, or the like.

Plural display cells are two-dimensionally arranged corresponding to plural pixels that form an image, in a display panel of the display device. Here, it is assumed that a direction along one coordinate axis of a two-dimensional orthogonal coordinate system corresponding to the image is a row direction and a direction along the other coordinate axis is a column direction. In the following description, the row direction and the column direction in the display panel correspond to a horizontal direction and a vertical direction of the image, but the horizontal and vertical directions are definitions for convenience. For example, in a display device capable of switching vertical and horizontal displays of an image on the same display panel, the row direction and the column direction of the display panel may correspond to the vertical direction and the horizontal direction of the image, respectively. Further, a structure of the display device may have a configuration in which the row direction and the column direction are switched, for example, in a structure described below.

First Exemplary Embodiment

FIG. 1 is a schematic diagram illustrating a configuration of an outline of an organic EL display device 2 according to a first exemplary embodiment. The organic EL display device 2 includes a pixel array section 4 that displays an image, and a drive unit (drive circuit) that drives the pixel array. The organic EL display device 2 is a flat panel display, and includes a display panel, in which the pixel array section 4 is provided in the display panel.

Plural display cells are two-dimensionally arranged corresponding to plural pixels that form an image, in the pixel array section 4. The organic EL display device 2 may individually drive the plural display cells. In the present exemplary embodiment, the display cells are arranged in a matrix form. An OLED 6 and a pixel circuit 8 are provided in each display cell. The pixel circuit 8 includes plural TFTs 10 and 12 and a capacitor 14.

Additionally, the drive unit includes a scanning line drive circuit 20, a video line drive circuit 22, a drive power supply circuit 24, and a control unit 26, and drives the pixel circuit 8 to control light emission of the OLED 6.

The scanning line drive circuit 20 is connected to a scanning signal line 28 provided for each display cell row. The scanning line drive circuit 20 selects the scanning signal line 28 according to a timing signal input from the control unit 26, and applies a voltage for turning on the lighting TFT 10 to the selected scanning signal line 28.

The video line drive circuit 22 is connected to a video signal line 30 provided for each display cell column. The video line drive circuit 22 receives an input of a video signal from the control unit 26, and outputs a voltage depending on a video signal of a pixel row to be displayed to each video signal line 30 at a timing that matches a selection timing of the scanning signal line 28 corresponding to the pixel row by the scanning line drive circuit 20. The voltage is written into the capacitor 14 through the lighting TFT 10 by the display cell row selected by the scanning signal line 28. The drive TFT 12 supplies an electric current depending on the written voltage to the OLED 6, and thus, the OLED 6 of the display cell corresponding to the selected scanning signal line 28 emits light.

The drive power supply circuit 24 is connected to a drive power supply line 32 provided for each display cell column, and supplies an electric current to the OLED 6 through the drive power supply line 32 and the drive TFT 12 of the selected display cell row.

Here, an anode of the OLED 6 is connected to the drive TFT 12. On the other hand, a cathode of each OLED 6 is connected to a ground potential, and the cathodes of the OLEDs 6 of all pixels are configured by a common electrode.

Figure 2:
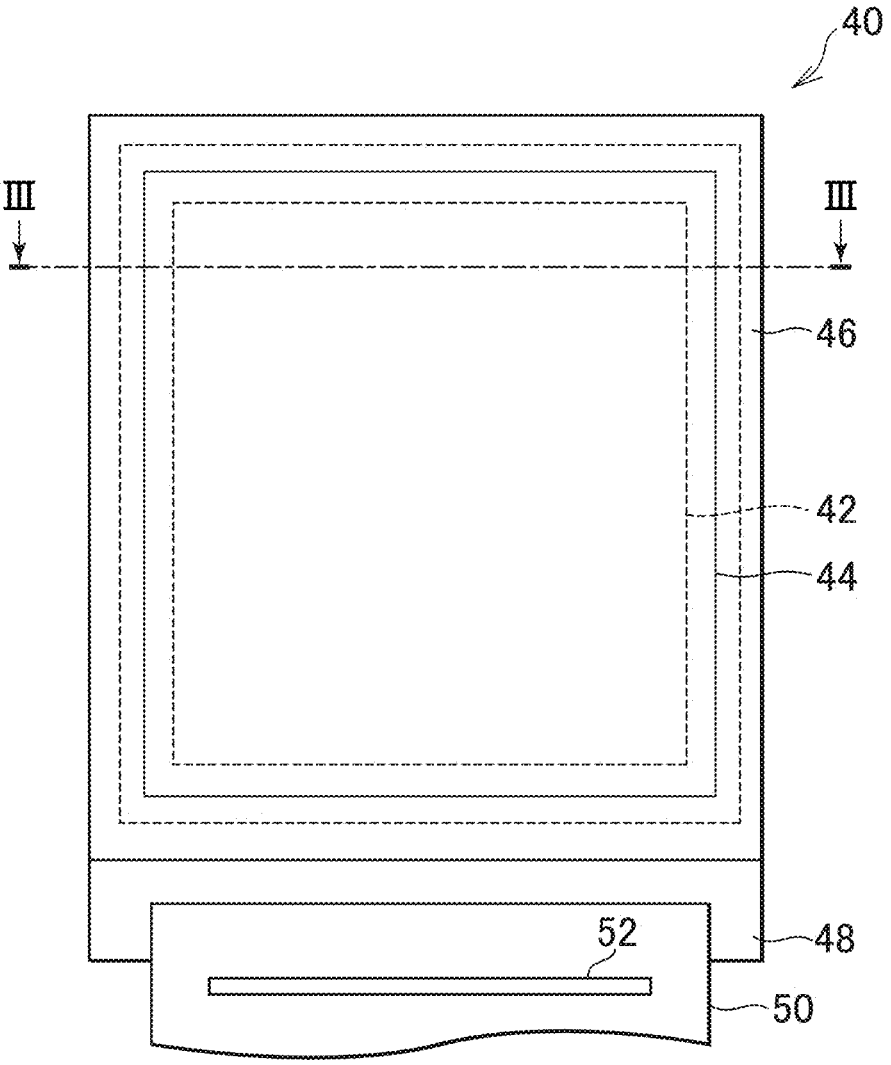
FIG. 2 is a schematic plan view illustrating a display panel of the organic EL display device according to the first exemplary embodiment of the invention.

FIG. 2 is a schematic plan view of a display panel 40 of the organic EL display device 2. The pixel array section 4 is disposed in a display region 42 of the display panel 40, and the OLEDs are arranged in the pixel array section 4, as described above. As described above, a cathode 44 that forms the OLED 6 is formed in common for the respective display cells, and covers the entirety of the display region 42.

On one side of the rectangular display panel 40, a terminal region 48 of which wirings are extracted from the pixel array section 4 is provided, and a flexible printed circuit (FPC) 50 is connected to the terminal region 48. A driver IC 52 that forms the drive unit is mounted on the FPC 50.

Figure 3:
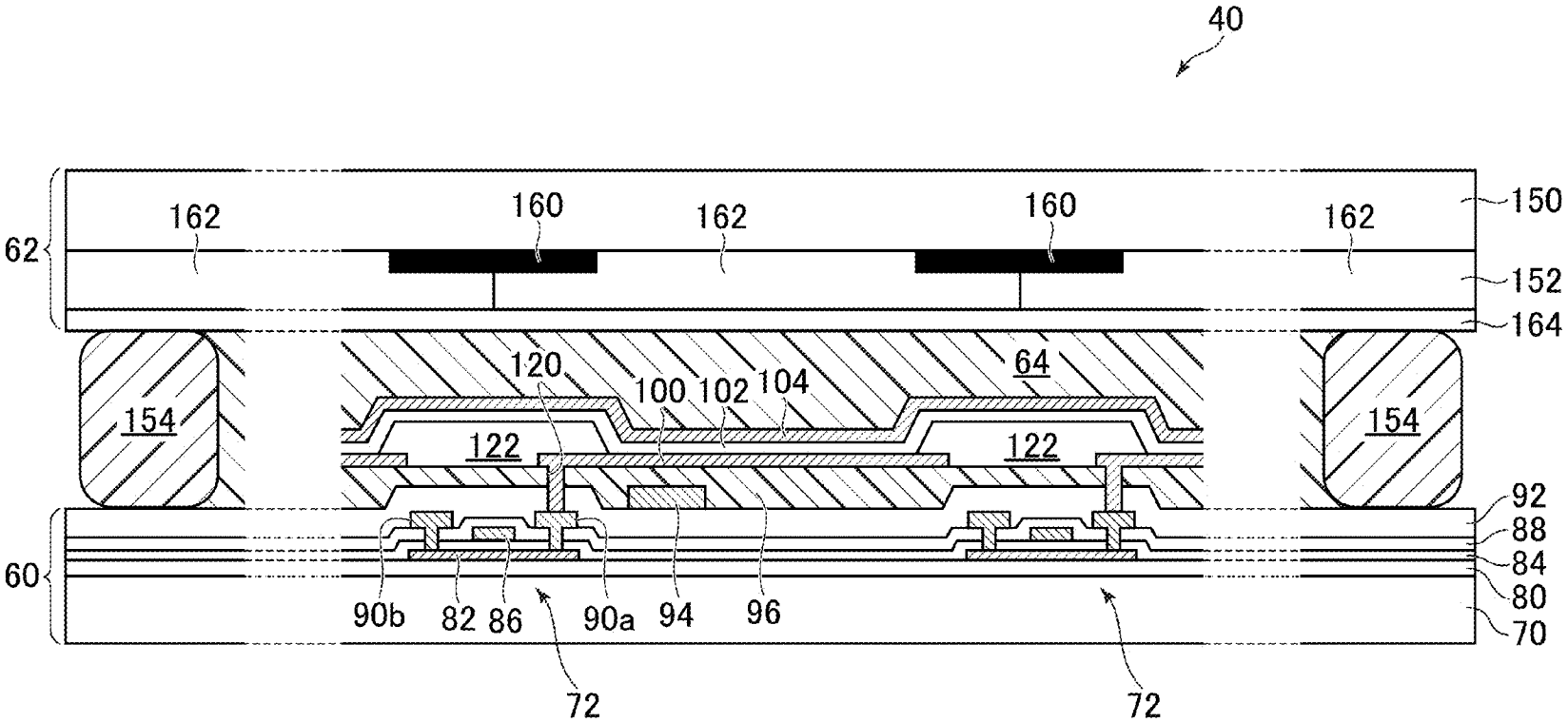
FIG. 3 is a schematic longitudinal section view of a display panel at a position along line III-III shown in FIG. 2.

FIG. 3 is a schematic longitudinal section view of the display panel 40 at a position along line III-III shown in FIG. 2. The organic EL display device 2 has a structure in which an element substrate 60 and a counter substrate 62 are attached to each other with a filling material 64 interposed therebetween. In the present exemplary embodiment, the pixel array section is a top emission type, in which the OLED 6 which is a light emitting element is formed on the element substrate 60 and light generated by the OLED 6 is output from the counter substrate 62. That is, in FIG. 3, the light from the OLED is output upward. A coloring method in the organic EL display device 2 is a color filter method, for example. Here, white light is generated by the OLED and passes through a color filter, for example, to thereby form display cells that emit light with colors such as red (R), green (G) and blue (B). Further, a display cell in which the color filter is not provided may emit white light (W).

The element substrate 60 has a configuration in which a circuit formed by a TFT 72 and the like, the OLED 6, and the like are formed on a bottom substrate 70 made of a glass or resin film by stacking and patterning various types of layers.

Specifically, a polysilicon (p-Si) layer is formed on the bottom substrate 70 through an underlayer 80 made of an inorganic insulating material such as silicon nitride (SiN) or silicon oxide (SiO), and a semiconductor region 82 which serves as a channel section, a source section and a drain section of the TFT 72 is formed by the p-Si layer.

After forming the semiconductor region 82, a gate insulating film 84 is stacked. The gate insulating film 84 may be formed of SiO, for example, and may be formed by a chemical vapor deposition (CVD) method. In the semiconductor region 82, a gate electrode 86 is disposed in the channel section of the TFT 72 through the gate insulating film 84. The gate electrode 86 is formed by patterning a metal film formed by sputtering or the like. Then, an inter-layer insulating film 88 that covers the gate electrode 86 is stacked. The inter-layer insulating film 88 may be formed by stacking SiN, SiO or the like using the CVD method, for example.

Contact holes that respectively reach the source section and the drain section of the semiconductor region 82 while passing through the inter-layer insulating film 88 and the gate insulating film 84 are formed, a metal film is formed inside the contact holes and on the inter-layer insulating film 88 by sputtering, and then, the metal film is patterned to form wirings, a source electrode 90*a* and a drain electrode 90*b* of the TFT 72, and the like.

After forming the TFT 72 in this way, an inter-layer insulating film 92 is stacked. The inter-layer insulating film 92 is formed by stacking SiN, SiO or the like by the CVD method, for example.

A metal film formed by sputtering or the like may be patterned to form a wiring 94 or the like on a surface of the inter-layer insulating film 92. Further, the scanning signal line 28, the video signal line 30, and the drive power supply line 32 may be formed with a multi-wiring structure by the metal film for the wiring 94 and the metal film used for formation of the gate electrode 86, for example.

A flattening film 96 is formed by stacking an organic material such as acrylic resin thereon, and the OLED 6 is formed on the flattened surface of the display region 42. The OLED 6 includes a lower electrode 100, an organic material layer 102, and an upper electrode 104. The lower electrode 100, the organic material layer 102, and the upper electrode 104 are sequentially stacked from the bottom substrate 70. In the present exemplary embodiment, the lower electrode 100 is the anode of the OLED, and the upper electrode 104 is the cathode thereof.

The organic material layer 102 includes a hole transport layer, a light emitting layer, an electron transport layer, and the like.

An upper structure with reference to the flattening film 96 on the element substrate 60 will be described in detail. The electrode material which becomes the lower electrode 100 is stacked after forming a contact hole 120 for connecting the lower electrode 100 to the TFT 72 on the flattening film 96. If the TFT 72 shown in FIG. 3 is the drive TFT 12 having an n-channel, the lower electrode 100 is connected to the source electrode 90*a* of the TFT 72. Specifically, the contact hole 120 that reaches the source electrode 90*a* is formed in the flattening film 96 and the inter-layer insulating film 92. Further, a conductive film is formed on the surface of the flattening film 96 and inside the contact hole 120, and is then patterned to form the lower electrode 100 electrically connected to the source electrode 90*a* for each display cell through the contact hole 120.

The lower electrode 100 may be formed of a transparent electrode material such as indium tin oxide (ITO) or the like, for example. The ITO film may be formed by a reactive sputtering method using an $Ar+O_2$ gas mixture. Further, the lower electrode 100 may be formed using another transparent electrode material, for example, indium zinc oxide (IZO), stannic oxide, zinc oxide, indium oxide or aluminum complex oxide.

As described above, the organic EL display device 2 of the present exemplary embodiment is the top emission type, in which the lower electrode 100 may have a double layer structure in which a transparent conductive film is stacked on a reflecting layer formed of a material having a high optical reflectance. For example, the reflecting layer may be formed of aluminum (Al), silver (Ag) or the like, and reflects light from a light emitting layer to a display surface, that is, to the counter substrate 62.

After forming the lower electrode 100, a bank 122 is formed at a boundary between the display cells. The lower electrode 100 is exposed in an effective pixel region surrounded by the bank 122. The bank 122 is preferably formed of an inorganic material from which moisture or oxygen gas is not easily discharged. Further, when the bank is formed of an organic material, before the organic material layer 102 of the OLED 6 is formed, it is preferable to sufficiently reduce moisture or oxygen gas in the bank 122 by a baking process in a vacuum, for example.

After forming the bank 122, respective layers that form the organic material layer 102 are sequentially stacked on the lower electrode 100. The upper electrode 104 is formed on the organic material layer 102 using a transparent electrode material. For example, the upper electrode 104 is formed of IZO by a reactive sputtering method using an $Ar+O_2$ gas mixture. The upper electrode 104 is a common electrode that is integrally formed over the plural display cells that form the pixel array section 4.

The counter substrate 62 is formed with a stacked structure 152 that includes a black matrix 160, a color filter 162, an overcoat layer 164 on a surface of a top substrate 150 formed of a transparent material such as glass, for example.

The element substrate 60 and the counter substrate 62 are disposed to face each other with a gap. Further, a dam material (sealing material) 154 is disposed in the gap while surrounding the display region, and seals the gap between the element substrate 60 and the counter substrate 62. The filling material 64 fills the gap inside the dam material 154. The filling material 64 and the dam material 154 are cured to bond both the substrates.

Figure 4:
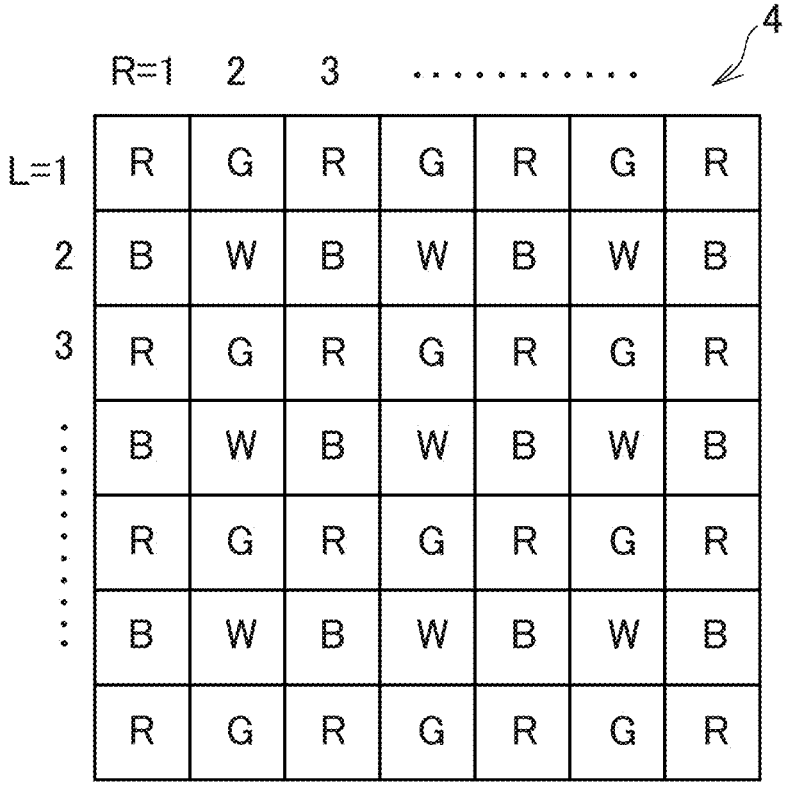
FIG. 4 is a schematic plan view illustrating an arrangement of plural types of display cells of a pixel array section of the organic EL display device according to the first exemplary embodiment of the invention.

FIG. 4 is a schematic plan view of the pixel array section 4, and shows an arrangement of plural types of display cells having different light emitting colors. In the figure, a row number L is written on a left side of the pixel array section 4, and a column number R is written on an upper side thereof. The display panel 40 of the present exemplary embodiment includes four types of display cells having different light emitting colors, which are arranged in a matrix form. The four types of display cells are arranged so that two types of display cells are alternately arranged in a row direction in each of the odd row and the even row, or are arranged so that two types of display cells are alternately arranged in a column direction in each of the odd column and the even column. Specifically, four types of display cells having respective light emitting colors of R, G, B, and W are arranged in the pixel array section 4 shown in FIG. 4. Hereinafter, for example, a display cell that emits light with color R is referred to as an R subpixel. In the configuration shown in FIG. 4, R subpixels and G subpixels are alternately arranged in the odd rows, and B subpixels and W subpixels are alternately arranged in the even rows. Further, the R subpixels and the B subpixels are alternately arranged in the odd columns, and the G subpixels and the W subpixels are alternately arranged in the even columns. The number of display cells of the pixel array section 4 is shown to be small for simplification in FIG. 4, but is not limited to the shown example. Further, combinations of two types of light emitting colors for each row and each column are not limited to the example shown in FIG. 4.

Next, characteristic points of the invention will be described with reference to a drive method of the display panel 40. FIG. 5 is a schematic diagram of an original image 200 of one frame displayed on the display panel 40 having the pixel array section 4 shown in FIG. 4. The original image 200 includes plural pixels that are arranged in a matrix form. A pixel in a j-th row and a k-th column in the image is represented as P(j, k). Further, a display cell (subpixel) of a j-th row and a k-th column in the display panel 40 is represented as S(j, k).

Figure 6:
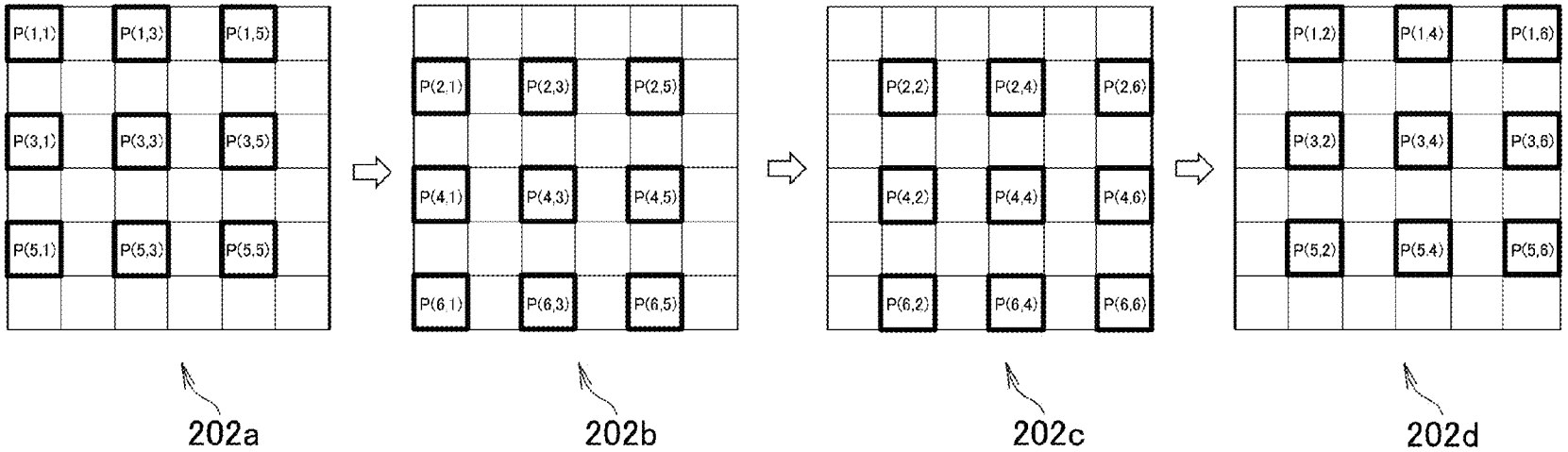
FIG. 6 is a schematic diagram illustrating sub-sampling images.

The drive circuit of the organic EL display device 2 decomposes the original image 200 into plural sub-sampling images formed by intermittent pixels in the row direction and the column direction, respectively, and sequentially displays the plural sub-sampling images on the display panel 40. FIG. 6 is a schematic diagram illustrating sub-sampling images in the present exemplary embodiment. In the present exemplary embodiment, the control unit 26 decomposes the original image 200 into four sub-sampling images of a first sub-sampling image 202*a* that includes pixels P(2n−1, 2m−1) in the odd rows and the odd columns, a second sub-sampling image 202*b* that includes pixels P(2n, 2m−1) in the even rows and the odd columns, a third sub-sampling image 202*c* that includes pixels P(2n, 2m) in the even rows and the even columns, and a fourth sub-sampling image 202*d* that includes pixels P(2n−1, 2m) in the odd rows and the even columns. Here, n and m are natural numbers. For example, the control unit 26 may include a field memory (frame memory) that stores an original image of one frame, and may sub-sample and read the original image stored in the memory to generate sub-sampling images.

Figure 7:
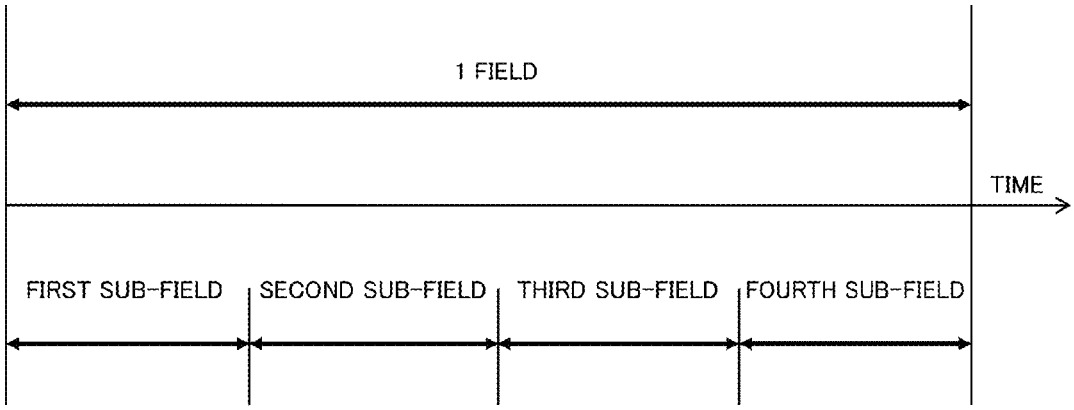
FIG. 7 is a timing chart illustrating a display operation of an original image according to the first exemplary embodiment of the invention.

FIG. 7 is a timing chart illustrating a display operation of the original image 200. In the related art, for example, the original image 200 of one frame is displayed on a display device through sequential scanning during a period of one field. Alternatively, the organic EL display device 2 divides one field into sub-fields of the same number as that of the sub-sampling images, and sequentially scans the sub-sampling images for each sub-field to perform display, for example. That is, the control unit 26 divides one field period into four sub-field periods, and sequentially displays the four sub-sampling images on the display panel 40. Thus, the original image obtained by combining four sub-sampling images is displayed for each field period in one frame.

In the display operation, the control unit 26 drives a display cell group that includes plural display cells that are two-dimensionally arranged and alternately adjacent to each other, corresponding to each pixel. Here, a display cell group corresponding to an arbitrary attention pixel in one sub-sampling image among two arbitrary sub-sampling images that form one original image, and a display cell group corresponding to a pixel adjacent to the attention pixel in the other sub-sampling image are overlapped, but are disposed to be mutually shifted.

Figure 8A:
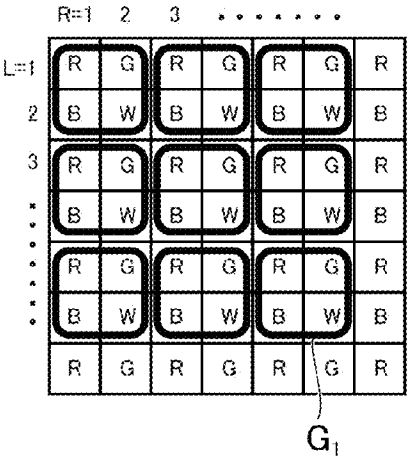
FIGS. 8A to 8D are schematic plan views of a pixel array section illustrating a display cell group according to the first exemplary embodiment of the invention.
Figure 8B:
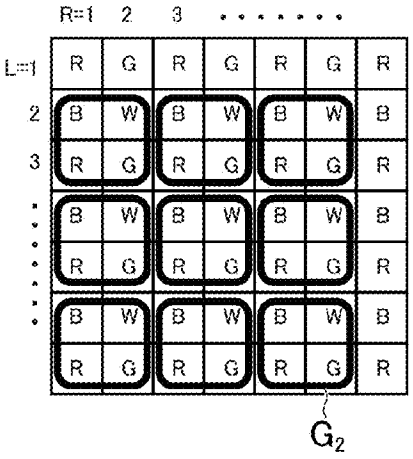
Figure 8C:
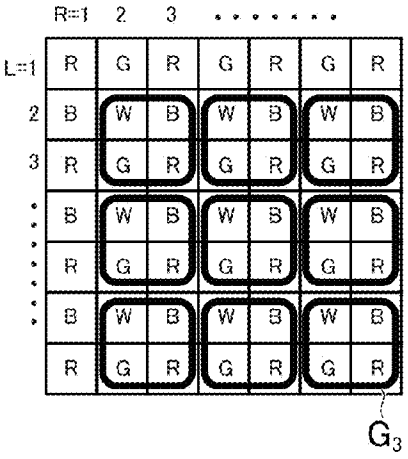
Figure 8D:
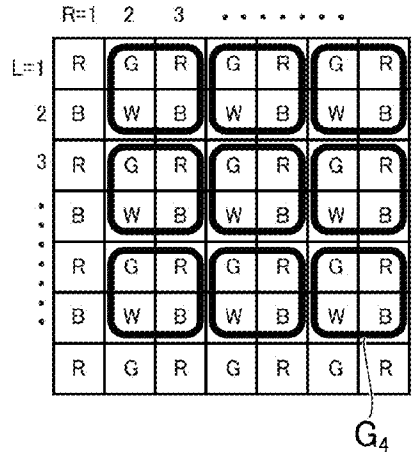

FIGS. 8A to 8D are schematic plan views of the pixel array section 4 indicating a display cell group corresponding to pixels of each sub-sampling image. FIG. 8A shows a display cell group $G_1$ corresponding to pixels of the first sub-sampling image 202*a*, and FIGS. 8B to 8D show display cell groups $G_2$ to $G_4$ corresponding to pixels of the second, third, and fourth sub-sampling images 202*b* to 202*d*, respectively.

Each of the display cell groups $G_1$ to $G_4$ includes four display cells that are arranged in two rows and two columns. Here, with respect to the display cell group $G_1$(2n−1, 2m−1) corresponding to the pixels P(2n−1, 2m−1) of the first sub-sampling image 202*a*, the display cell group $G_2$ (2n, 2m−1) corresponding to the pixels P(2n, 2m−1) of the second sub-sampling image 202*b* is shifted by one cell in the column direction, the display cell group $G_3$(2n, 2m) corresponding to the pixels P(2n, 2m) of the third sub-sampling image 202*c* is shifted by one cell in the column direction and the row direction, respectively, and the display cell group $G_4$(2n−1, 2m) corresponding to the pixels P(2n−1, 2m) of the fourth sub-sampling image 202*d* is shifted by one cell in the row direction.

For example, the display cell group $G_1$(2n−1, 2m−1) includes four sub-pixels S(2n−1, 2m−1), S(2n−1, 2m), S(2n, 2m−1), and S(2n, 2m), the display cell group $G_2$(2n, 2m−1) includes four sub-pixels S(2n, 2m−1), S(2n, 2m), S(2n+1, 2m−1), and S(2n+1, 2m), the display cell group $G_3$(2n, 2m) includes four sub-pixels S(2n, 2m), S(2n, 2m+1), S(2n+1, 2m), and S(2n+1, 2m+1), and the display cell group $G_4$(2n−1, 2m) includes four sub-pixels S(2n−1, 2m), S(2n−1, 2m+1), S(2n, 2m), and S(2n, 2m+1).

The pixel array section 4 is larger than the arrangement of the respective display cell groups that display the sub-sampling images, and thus, extra display cells that do not form the display cell group exist at edges of the pixel array section 4. Specifically, in FIG. 8A, display cells in one row at a lower edge and one column at a right edge remain so as not to form the display cell group $G_1$, in FIG. 8B, display cells in one row at an upper edge and one column at the right edge remain so as not to form the display cell group $G_2$, in FIG. 8C, display cells in one row at the upper edge and one column at a left edge remain so as not to form the display cell group $G_3$, and in FIG. 8D, display cells in one row at the lower edge and one column at the left edge remain so as not to form the display cell group $G_4$. A region of the edges formed by the extra display cells can be assigned as a non-light emitting region, for example. This is similarly applied to other exemplary embodiments.

Figure 9A:
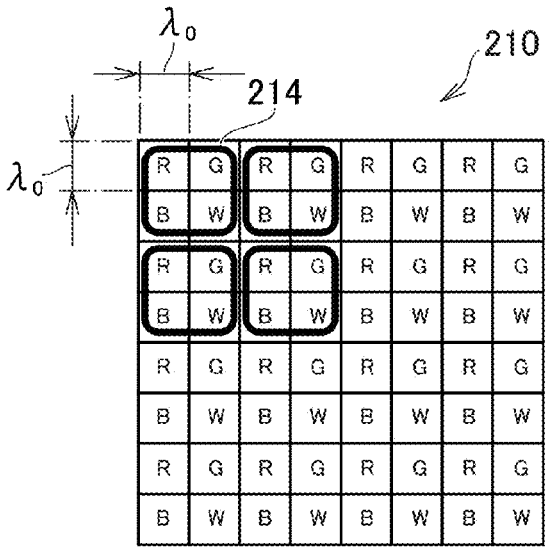
FIG. 9A is a schematic diagram illustrating pixel display in a display device in the related art.
Figure 9B:
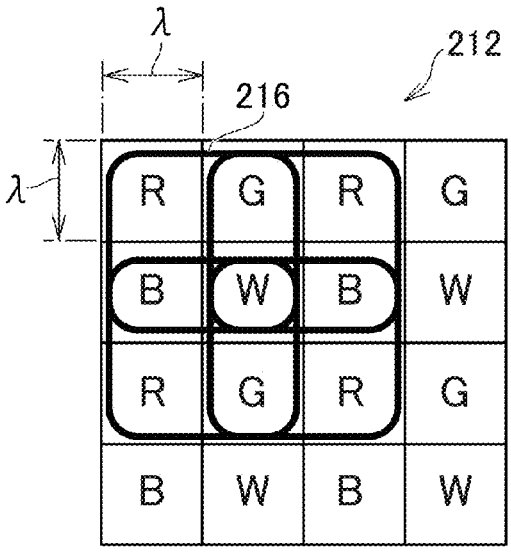
FIG. 9B is a schematic diagram illustrating pixel display in the organic EL display device according to the first exemplary embodiment of the invention.

As described above, in the organic EL display device 2, the display cell groups that respectively display one pixel are overlapped between adjacent pixels. FIGS. 9A and 9B are schematic diagrams illustrating a pixel display difference between the organic EL display device 2 in which the display cell groups are overlapped between adjacent pixels and a display device (referred to as a normal display device) in which the display cell groups are not overlapped between adjacent pixels. FIG. 9A shows an arrangement 210 of sub-pixels in the display panel of the normal display device, and FIG. 9B shows an arrangement 212 of sub-pixels in the display panel 40 of the organic EL display device 2.

For example, when an arrangement pitch of sub-pixels of the normal display device is expressed as $\lambda_0$ in the row direction and the column direction, respectively, an arrangement pitch of display cell groups 214 of 2×2 that display pixels becomes $2\lambda_0$ in the row direction and column direction, respectively, which leads to resolution of the display device. In the organic EL display device 2 of the present exemplary embodiment, when an arrangement pitch of sub-pixels is expressed as $\lambda$ in the row direction and the column direction, respectively, since adjacent display cell groups 216 are overlapped, an arrangement pitch of the display cell groups 216 becomes $\lambda$ in the row direction and column direction, respectively. When the organic EL display device 2 has the same resolution as that of the normal display device, since $\lambda=2\lambda_0$, the area of the sub-pixels can become four times larger. That is, the organic EL display device 2 can increase the area of the display cells without lowering the resolution and can increase an aperture ratio compared with the normal display device. Thus, it is possible to easily obtain a bright image or reduce power consumption. Further, it is not necessary to perform micro-processing as in the normal display device in formation of the pixel array section 4, and thus, the defect rate of the display cells is reduced, and yield in production of the display panel 40 is improved. On the other hand, when the size of the sub-pixels are the same, the organic EL display device 2 can double the resolution with respect to the horizontal direction and the vertical direction, respectively, compared with the normal display device.

Figure 10A:
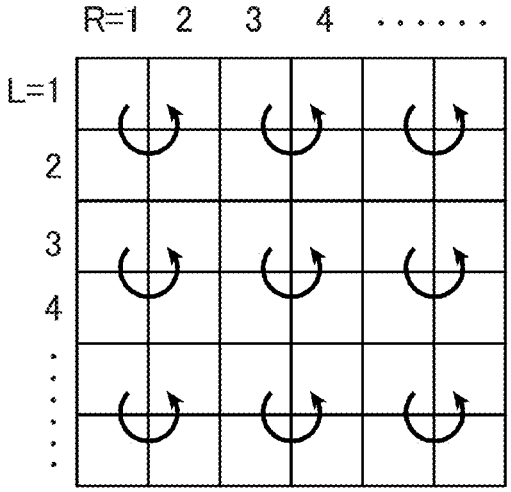
FIGS. 10A to 10D are schematic diagrams of images that show rotational driving in the invention.
Figure 10B:
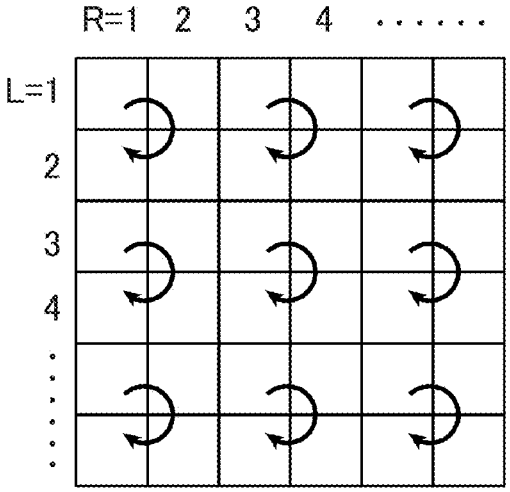
Figure 10C:
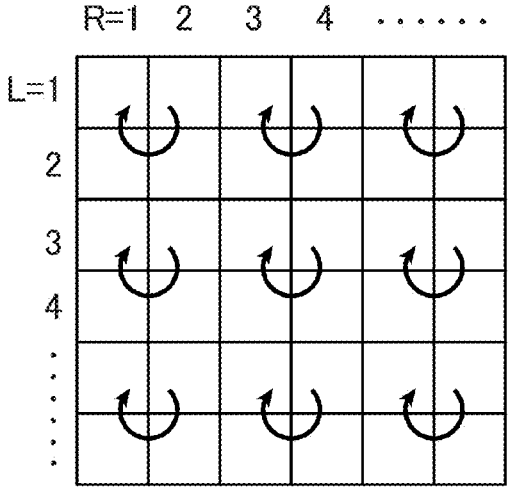
Figure 10D:
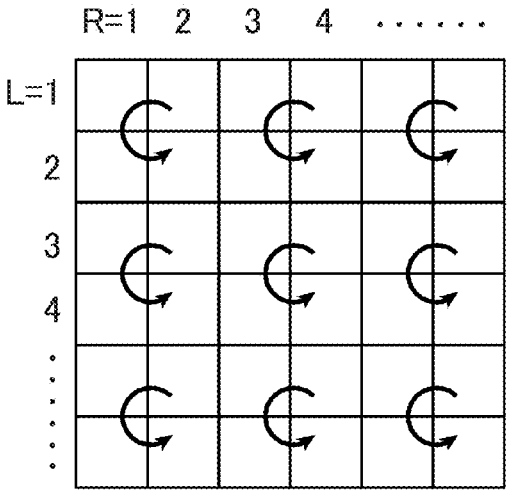
Figure 13A:
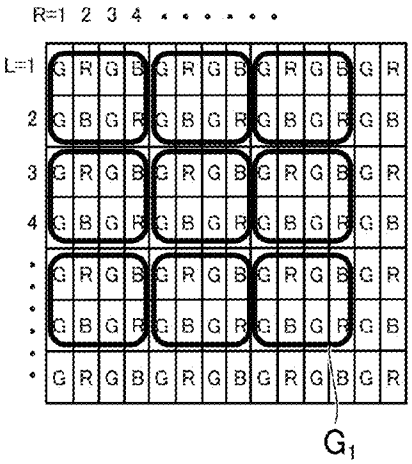
FIGS. 13A to 13D are schematic plan views of pixel array sections that show display cell groups according to the second exemplary embodiment of the invention.
Figure 13B:
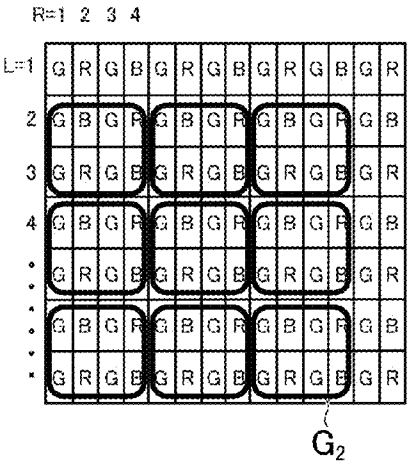
Figure 13C:
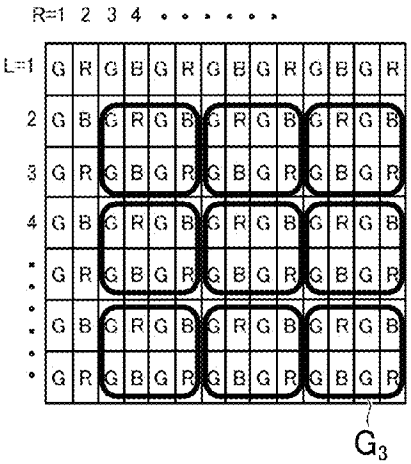
Figure 13D:
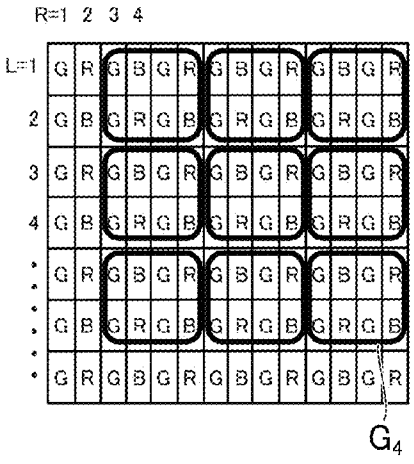

The control unit 26 may sequentially display the first to fourth sub-sampling images obtained by decomposing the original image on the display panel 40 in a circulating order according to an ascending or descending order of the ordinal numbers (first to fourth) attached to the sub-sampling images from any one of the first to fourth sub-sampling images. For example, the control unit 26 displays the first sub-sampling image 202*a* in a first sub-field, displays the second sub-sampling image 202*b* in a second sub-field, displays the third sub-sampling image 202*c* in a third sub-field, and displays the fourth sub-sampling image 202*d* in a fourth sub-field, on the display panel 40. Through such a driving method, as shown in FIG. 10A, in a 2×2 pixel region, displayed pixels move to be sequentially rotated as represented by an arrow. FIGS. 10A to 10D are schematic diagrams of images, which show the movement of the pixels in the above-described driving, but the display cell groups on the display panel 40 draw the same locus. Hereinafter, the driving method is referred to as rotational driving. A pixel which is a rotation starting point and a rotation direction may be variously changed, as illustrated in FIGS. 10B to 10D, according to which one of the sub-sampling images the subsequent display starts from, and according to whether the subsequent display is performed in the ascending order or in the descending order.

In the rotational driving, a moving distance of the display pixels (or display cell groups) between the sub-fields becomes short. Thus, image smoothness is improved when displaying a moving image. Further, in the rotational driving, since the non-light emitting region generated at the edge of the pixel array section 4 also moves to be rotated along the periphery of the pixel array section 4 and the change in the non-light emitting region is relatively smooth, a feeling of strangeness which a viewer receives from the image is reduced. Further, when the control unit 26 generates the sub-sampling images from image data stored in the field memory, since only any one of an X coordinate and a Y coordinate is changed in an XY address, in the memory, of pixel data of an immediately previous sub-sampling image and an XY address of pixel data of a sub-sampling image to be read next, it is possible to easily perform an operation of calculating the addresses. Thus, for example, it is possible to reduce the scale of a logic circuit, and to reduce the cost.

When an input video signal is an RGB signal, the control unit 26 converts the RGB signal into an RGBW signal. The conversion from the RGB signal into the RGBW signal may be performed using a known technique. For example, a W signal represents a signal strength depending on a brightness component (Y component) of a video signal, and the remaining components obtained by subtracting the W signal component from the video signal are assigned to respective color signals RGB after conversion.

In the above-described first exemplary embodiment, four types of display cells in the display panel 40 are arranged as shown in FIG. 4. In this arrangement, two types of display cells are alternately arranged in both the row direction and the column direction, but in the present exemplary embodiment, two types of display cells may be alternately arranged in only one direction of the row direction and the column direction, in the display panel 40. For example, FIG. 11 is a schematic plan view of the pixel array section 4 illustrating such an example. In FIG. 11, four types of display cells are arranged so that two types of display cells are alternately arranged in the column direction in each of the odd column and the even column. However, four types of display cells are arranged in each row. By driving the display panel 40 in basically the same way as the above-described method, it is possible to form the organic EL display device 2 having the same effects as the present exemplary embodiment. Further, using the display panel 40 in which two types of display cells are alternately arranged in each row and two types of display cells are not alternately arranged in each column, it is possible to form the organic EL display device 2 having the same effects as the present exemplary embodiment.

The control unit 26 may display the first to fourth sub-sampling images in an order that does not follow the rotational driving. For example, the control unit 26 may perform the display in the order of the first, the third, the second, and the fourth sub-sampling images.

Second Exemplary Embodiment

With respect to an organic EL display device 2 according to a second exemplary embodiment, the same reference numerals are given to the same components as in the first exemplary embodiment, and basic description thereof will not be repeated. Hereinafter, different points from the first exemplary embodiment will mainly be described.

FIG. 12 is a schematic plan view of a pixel array section 4 according to the second exemplary embodiment, and shows an arrangement of plural types of display cells having different light emitting colors. A display panel 40 of the present exemplary embodiment has three types of display cells having different light emitting colors, which are arranged in a matrix form, in which a column in which a first type of display cell and a second type of display cell are alternately arranged in every cell and a column in which a third type of display cell is arranged in a stripe form are alternately arranged in a row direction, and the first type of display cell and the second type of display cell are alternately arranged in every other cell in each row of the display cells. Specifically, in the pixel array section 4 shown in FIG. 12, an R sub-pixel and a B sub-pixel are arranged as the first and second types of display cells, and a G sub-pixel is arranged as the third type of display cell. Further, in the configuration shown in FIG. 12, the R sub-pixels and the B sub-pixels are alternately arranged in the even columns, and the G sub-pixels are arranged in the stripe form in the odd columns. Further, arrangement phases of the R sub-pixel and the B sub-pixel are shifted in adjacent even columns, and the R sub-pixel and the B sub-pixel are alternately arranged in every other cell in each row. This arrangement is referred to as a PenTile arrangement.

The control unit 26 decomposes an original image into four sub-sampling images 202*a* to 202*d*, similar to the first exemplary embodiment. FIGS. 13A to 13D are schematic plan views of the pixel array section 4 indicating display cell groups corresponding to pixels of the respective sub-sampling images. FIGS. 13A to 13D show display cell groups $G_1$ to $G_4$ corresponding to pixels of the first, second, third, and fourth sub-sampling images 202*a* to 202*d*, respectively.

Each of the display cell groups $G_1$ to $G_4$ includes eight display cells that are arranged in two rows and four columns. Here, with respect to the display cell group $G_1(2n-1, 2m-1)$ corresponding to pixels $P(2n-1, 2m-1)$ of the first sub-sampling image 202*a*, the display cell group $G_2(2n, 2m-1)$ corresponding to pixels $P(2n, 2m-1)$ of the second sub-sampling image 202*b* is shifted by one cell in the column direction, the display cell group $G_3(2n, 2m)$ corresponding to pixels $P(2n, 2m)$ of the third sub-sampling image 202*c* is shifted by one cell in the column direction and is shifted by two cells in the row direction, and the display cell group $G_4(2n-1, 2m)$ corresponding to pixels $P(2n-1, 2m)$ of the fourth sub-sampling image 202*d* is shifted by two cells in the row direction.

For example, the display cell group $G_1(2n-1, 2m-1)$ includes eight sub-pixels $S(2n-1, 2m-1)$ to $S(2n-1, 2m+2)$ and $S(2n, 2m-1)$ to $S(2n, 2m+2)$; the display cell group $G_2(2n, 2m-1)$ includes eight sub-pixels $S(2n, 2m-1)$ to $S(2n, 2m+2)$ and $S(2n+1, 2m-1)$ to $S(2n+1, 2m+2)$; the display cell group $G_3(2n, 2m)$ includes eight sub-pixels S(2n, 2m+1) to S(2n, 2m+4) and S(2n+1, 2m+1) to S(2n+1, 2m+4); and the display cell group $G_4$(2n−1, 2m) includes eight sub-pixels S(2n−1, 2m+1) to S(2n−1, 2m+4) and S(2n, 2m+1) to S(2n, 2m+4).

In the present exemplary embodiment, the resolution is improved by overlapping the display cell groups. Further, the same effects as in the first exemplary embodiment are obtained by the rotational driving.

First Modification Example of the Second Exemplary Embodiment

In the arrangement of the display cells shown in FIG. 12, each of the display cell groups $G_1$ to $G_4$ may be configured to include four display cells that are arranged in two rows and two columns, similar to the first exemplary embodiment. In this configuration, similar to the first exemplary embodiment, with respect to the display cell group $G_1$(2n−1, 2m−1) corresponding to the pixels P(2n−1, 2m−1) of the first sub-sampling image 202*a*, the display cell group $G_2$(2n, 2m−1) corresponding to the pixels P(2n, 2m−1) of the second sub-sampling image 202*b* is shifted by one cell in the column direction, the display cell group $G_3$(2n, 2m) corresponding to the pixels P(2n, 2m) of the third sub-sampling image 202*c* is shifted by one cell in the column direction and the row direction, respectively, and the display cell group $G_4$(2n−1, 2m) corresponding to the pixels P(2n−1, 2m) of the fourth sub-sampling image 202*d* is shifted by one cell in the row direction.

In this configuration, four sub-pixels that form each of the display cell groups $G_1$ to $G_4$ are the same as in the first exemplary embodiment. For example, the display cell group $G_1$(2n−1, 2m−1) includes four sub-pixels S(2n−1, 2m−1), S(2n−1, 2m), S(2n, 2m−1), and S(2n, 2m); the display cell group $G_2$(2n, 2m−1) includes four sub-pixels S(2n, 2m−1), S(2n, 2m), S(2n+1, 2m−1), and S(2n+1, 2m); the display cell group $G_3$(2n, 2m) includes four sub-pixels S(2n, 2m), S(2n, 2m+1), S(2n+1, 2m), and S(2n+1, 2m+1); and the display cell group $G_4$(2n−1, 2m) includes four sub-pixels S(2n−1, 2m), S(2n−1, 2m+1), S(2n, 2m), and S(2n, 2m+1).

Second Modification Example of the Second Exemplary Embodiment

A modification example of the second exemplary embodiment to be described herein has a configuration in which one of four arbitrary display cells that are arranged in two rows and two columns in the arrangement focused on only the third type of display cells in FIG. 12 is replaced with a fourth type of display cell having a light emitting color different from those of the first to third types of display cells. That is, in this configuration, the display panel 40 has a configuration in which one of the third type of four display cells that are arranged in two columns with one arbitrary column in which the first and second types of display cells interposed therebetween are arranged, in two adjacent arbitrary rows, is replaced with the fourth type of display cell.

FIG. 14 is a schematic plan view of the pixel array section 4 in this configuration, and shows an arrangement of plural types of display cells having different light emitting colors. Here, a part of the G sub-pixels corresponding to the third type of display cells is replaced with a W sub-pixel corresponding to the fourth type of display cell. In the configuration shown in FIG. 14, a sub-pixel S(2n, 4m−3) corresponds to the W sub-pixel.

Further, a configuration in which S(2n, 8m−7) and S(2n−1, 8m−3) among the G sub-pixels shown in FIG. 12 are replaced with the W sub-pixels may be used.

A video signal with respect to a display cell group including the W sub-pixel is generated by conversion from the RGB signal to the RGBW signal, as described in the first exemplary embodiment.

Further, the display cell groups $G_1$ to $G_4$ may include the 2×2 configuration described in the first modification example of the second exemplary embodiment, instead of the 2×4 configuration described in the second exemplary embodiment.

Third Modification Example of the Second Exemplary Embodiment

Another modification example of the second exemplary embodiment has a configuration in which two display cells which are arranged in a diagonal direction among four arbitrary display cells that are arranged in two rows and two columns in the arrangement focused on only the third type of display cells in FIG. 12 are replaced with a fourth type of display cells having a light emitting color different from those of the first to third types of display cells. That is, in this configuration, the display panel 40 has a configuration in which two display cells which are arranged in a diagonal direction among the third type of four display cells that are arranged in two columns with one arbitrary column in which the first and second types of display cells interposed therebetween are arranged, in two adjacent arbitrary rows, are replaced with the fourth type of display cells.

FIG. 15 is a schematic plan view of the pixel array section 4 in this configuration, and shows an arrangement of plural types of display cells having different light emitting colors. Here, a part of the G sub-pixels corresponding to the third type of display cells is replaced with a W sub-pixel corresponding to the fourth type of display cell. In the configuration shown in FIG. 15, sub-pixels S(2n, 4m−3) and S(2n−1, 4m−1) correspond to the W sub-pixels.

A video signal with respect to a display cell group including the W sub-pixel is generated by conversion from the RGB signal to the RGBW signal, as described in the first exemplary embodiment.

Further, the display cell groups $G_1$ to $G_4$ may include the 2×2 configuration described in the first modification example of the second exemplary embodiment, instead of the 2×4 configuration described in the second exemplary embodiment.

Third Exemplary Embodiment

With respect to an organic EL display device 2 according to a third exemplary embodiment, the same reference numerals are given to the same components as in the first exemplary embodiment, and basic description thereof will not be repeated. Hereinafter, different points from the first exemplary embodiment will be mainly described.

Figure 16:
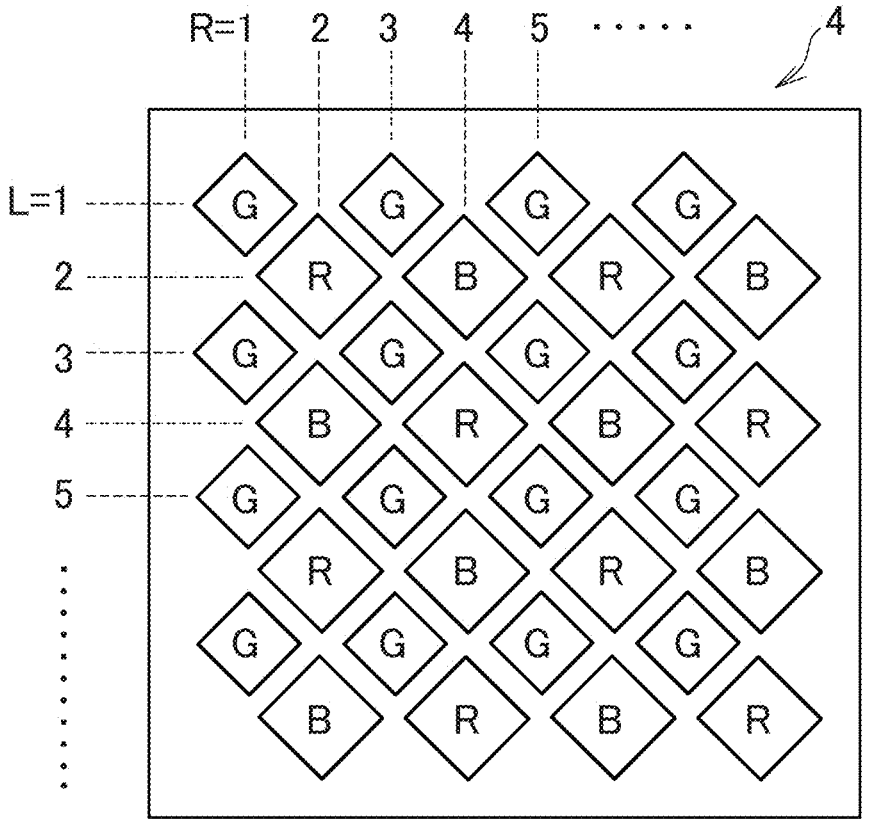
FIG. 16 is a schematic plan view illustrating an arrangement of display cells of a pixel array section according to a third exemplary embodiment of the invention.
Figure 17A:
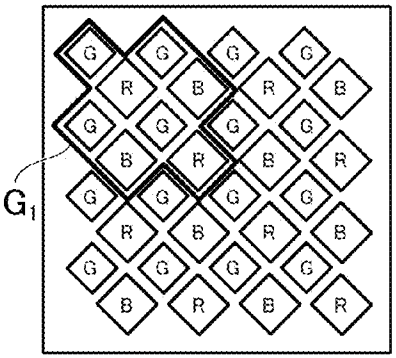
FIGS. 17A to 17D are schematic plan views of a pixel array section illustrating a display cell group according to the third exemplary embodiment of the invention.
Figure 17B:
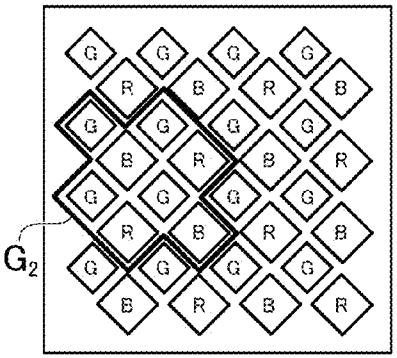
Figure 17C:
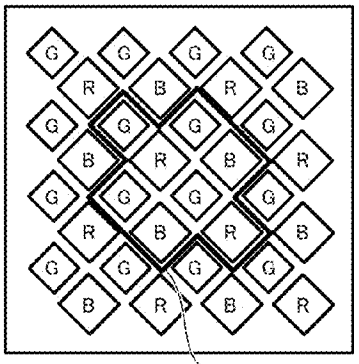
Figure 17D:
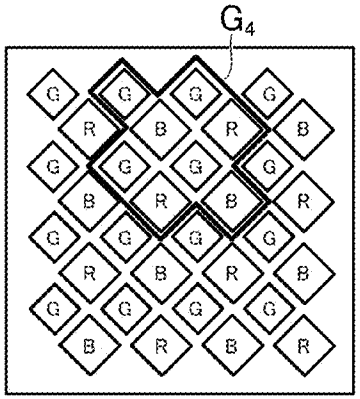
Figure 18A:
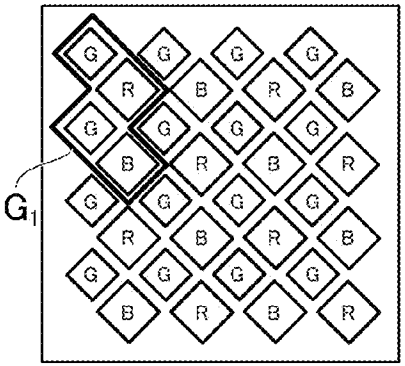
FIGS. 18A to 18D are schematic plan views of a pixel array section illustrating a display cell group according to a first modification example of the third exemplary embodiment of the invention.
Figure 18B:
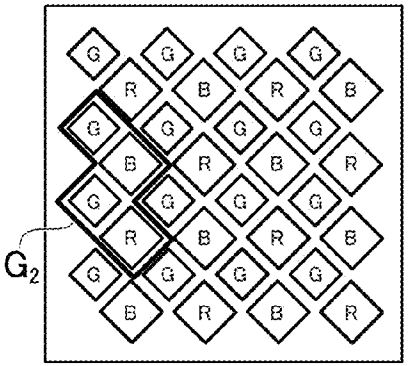
Figure 18C:
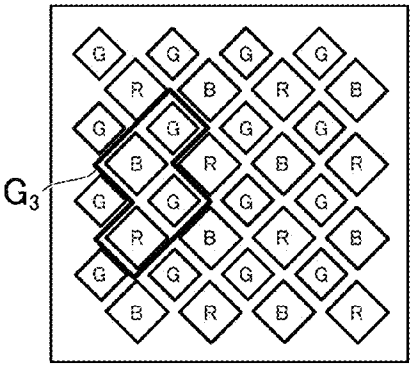
Figure 18D:
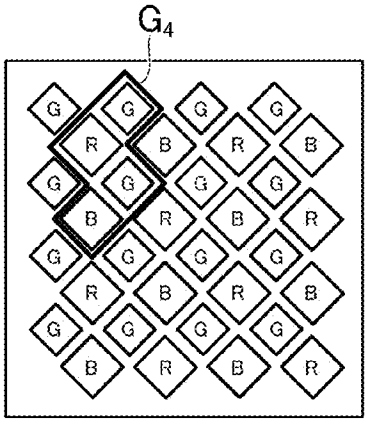

FIG. 16 is a schematic plan view of a pixel array section 4 according to the third exemplary embodiment, and shows an arrangement of plural types of display cells having different light emitting colors. Positions of the display cells in the display panel 40 correspond to grid points of a staggered grid in which two rectangular grids are arranged to be shifted. Here, rows and columns in the display panel 40 are defined so that gridpoints of a first rectangular grid correspond to positions of display cells in even rows and positions of display cells in even columns and grid points of a second rectangular grid that is shifted in the row direction and the column direction with respect to the first rectangular grid correspond to positions of display cells in odd rows and positions of display cells in odd columns.

The display panel 40 of the present exemplary embodiment has three types of display cells having different light emitting colors. For example, at the grid points of the first rectangular grid, first and second types of display cells are alternately arranged in the row direction and the column direction, and a third type of display cell is arranged in each grid point of the second rectangular grid. Specifically, in the pixel array section 4 shown in FIG. 16, an R sub-pixel and a B sub-pixel are arranged as the first and second types of display cells, and a G sub-pixel is arranged as the third type of display cell. This arrangement is referred to as a diamond PenTile arrangement.

The control unit 26 decomposes an original image into four sub-sampling images 202*a* to 202*d*, similar to the first and second exemplary embodiments. FIGS. 17A to 17D are schematic plan views of the pixel array section 4 indicating display cell groups corresponding to pixels of the respective sub-sampling images. FIGS. 17A to 17D show display cell groups $G_1$ to $G_4$ corresponding to pixels of the first, second, third, and fourth sub-sampling images 202*a* to 202*d*, respectively.

Each of the display cell groups $G_1$ to $G_4$ includes eight display cells that are arranged in four rows and four columns. Here, with respect to the display cell group $G_1$(2n−1, 2m−1) corresponding to the pixels P(2n−1, 2m−1) of the first sub-sampling image 202*a*, the display cell group $G_2$(2n, 2m−1) corresponding to the pixels P(2n, 2m−1) of the second sub-sampling image 202*b* is shifted by two rows in the column direction, the display cell group $G_3$(2n, 2m) corresponding to the pixels P(2n, 2m) of the third sub-sampling image 202*c* is shifted by two rows in the column direction and is shifted by two columns in the row direction, and the display cell group $G_4$(2n−1, 2m) corresponding to the pixels P(2n−1, 2m) of the fourth sub-sampling image 202*d* is shifted by two columns in the row direction.

For example, the display cell group $G_1$(2n−1, 2m−1) includes eight sub-pixels S(2n−1, 2m−1), S(2n−1, 2m+1), S(2n, 2m), S(2n, 2m+2), S(2n+1, 2m−1), S(2n+1, 2m+1), S(2n+2, 2m), and S(2n+2, 2m+2); the display cell group $G_2$(2n, 2m−1) includes eight sub-pixels S(2n+1, 2m−1), S(2n+1, 2m+1), S(2n+2, 2m), S(2n+2, 2m+2), S(2n+3, 2m−1), S(2n+3, 2m+1), S(2n+4, 2m), and S(2n+4, 2m+2); the display cell group $G_3$(2n, 2m) includes eight sub-pixels S(2n+1, 2m+1), S(2n+1, 2m+3), S(2n+2, 2m+2), S(2n+2, 2m+4), S(2n+3, 2m+1), S(2n+3, 2m+3), S(2n+4, 2m+2), and S(2n+4, 2m+4); and the display cell group $G_4$(2n−1, 2m) includes eight sub-pixels S(2n−1, 2m+1), S(2n−1, 2m+3), S(2n, 2m+2), S(2n, 2m+4), S(2n+1, 2m+1), S(2n+1, 2m+3), S(2n+2, 2m+2), and S(2n+2, 2m+4).

In the present exemplary embodiment, similarly, the resolution is improved by overlapping the display cell groups. Further, the same effects as in the first exemplary embodiment are obtained by the rotational driving.

First Modification Example of the Third Exemplary Embodiment

In the arrangement of the display cells shown in FIG. 16, a configuration in which each of the display cell groups $G_1$ to $G_4$ includes four display cells that are arranged in four rows and two columns may be used. FIGS. 18A to 18D are schematic plan views of the pixel array section 4 indicating the display cell groups corresponding to the pixels of the respective sub-sampling images. FIGS. 18A to 18D show display cell groups $G_1$ to $G_4$ corresponding to pixels of the first, second, third, and fourth sub-sampling images 202*a* to 202*d*, respectively. With respect to the display cell group $G_1$(2n−1, 2m−1) corresponding to the pixels P(2n−1, 2m−1) of the first sub-sampling image 202*a*, the display cell group $G_2$(2n, 2m−1) corresponding to the pixels P(2n, 2m−1) of the second sub-sampling image 202*b* is shifted by two rows in the column direction, the display cell group $G_3$(2n, 2m) corresponding to the pixels P(2n, 2m) of the third sub-sampling image 202*c* is shifted by two rows in the column direction and is shifted by one column in the row direction, and the display cell group $G_4$(2n−1, 2m) corresponding to the pixels P(2n−1, 2m) of the fourth sub-sampling image 202*d* is shifted by one column in the row direction.

For example, the display cell group $G_1$(2n−1, 2m−1) includes four sub-pixels S(2n−1, 2m−1), S(2n, 2m), S(2n+1, 2m−1), and S(2n+2, 2m); the display cell group $G_2$(2n, 2m−1) includes four sub-pixels S(2n+1, 2m−1), S(2n+2, 2m), S(2n+3, 2m−1), and S(2n+4, 2m); the display cell group $G_3$(2n, 2m) includes four sub-pixels S(2n+1, 2m+1), S(2n+2, 2m), S(2n+3, 2m+1), and S(2n+4, 2m); and the display cell group $G_4$(2n−1, 2m) includes four sub-pixels S(2n−1, 2m+1), S(2n, 2m), S(2n+1, 2m+1), and S(2n+2, 2m).

Second Modification Example of the Third Exemplary Embodiment

A modification example of the third exemplary embodiment to be described herein has a configuration in which one of four arbitrary display cells that are arranged in two rows and two columns in the arrangement focused on only the third type of display cells in FIG. 16 is replaced with a fourth type of display cell having a light emitting color different from those of the first to third types of display cells. That is, in this configuration, the display panel 40 has a configuration in which one of the third type of four arbitrary display cells that are arranged in two rows and two columns in the second rectangular grid is replaced with the fourth type of display cell having a light emitting color different from those of the first to third types of display cells.

Figure 19:
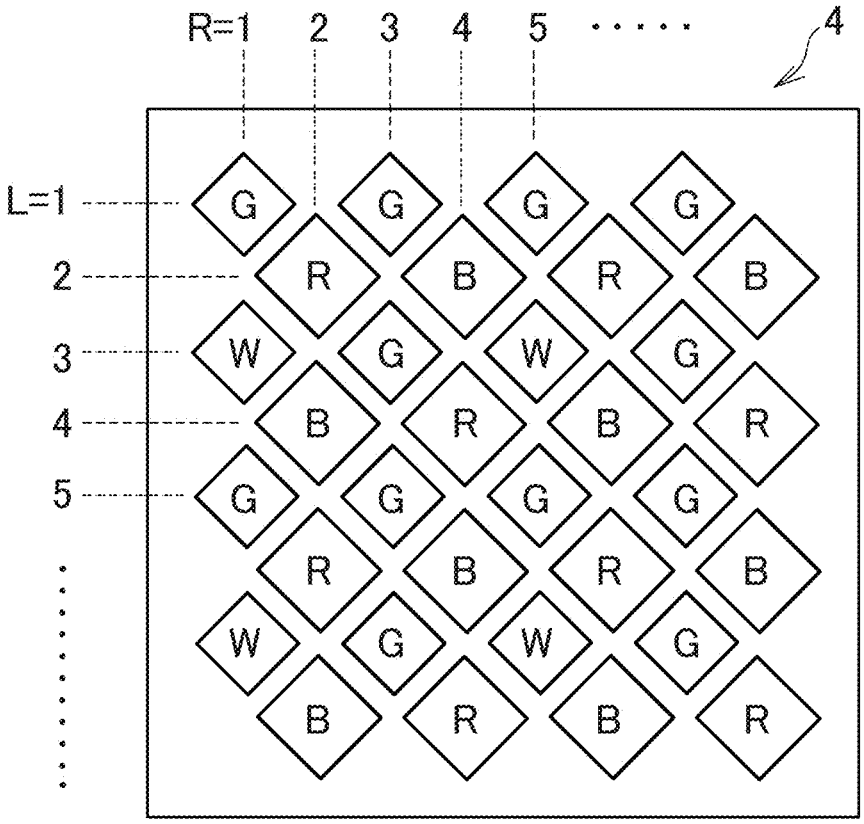
FIG. 19 is a schematic plan view illustrating an arrangement of display cells of a pixel array section according to a second modification example of the third exemplary embodiment of the invention.

FIG. 19 is a schematic plan view of the pixel array section 4 in this configuration, and shows an arrangement of plural types of display cells having different light emitting colors. Here, a part of the G sub-pixels corresponding to the third type of display cells is replaced with W sub-pixels corresponding to the fourth type of display cells. In the configuration shown in FIG. 19, a sub-pixel S(4n−1, 4m−3) corresponds to the W sub-pixel.

Further, a configuration in which S(4n−1, 8m−7) and S(4n−3, 8m−3) among the G sub-pixels shown in FIG. 12 are replaced with the W sub-pixels may be used.

A video signal with respect to a display cell group including the W sub-pixel is generated by conversion from the RGB signal to the RGBW signal, as described in the first exemplary embodiment.

Further, the display cell groups $G_1$ to $G_4$ may include the 4×2 configuration described in the first modification example of the third exemplary embodiment, instead of the 4×4 configuration described in the third exemplary embodiment.

Third Modification Example of the Third Exemplary Embodiment

Another modification example of the third exemplary embodiment has a configuration in which two display cells which are arranged in a diagonal direction among four arbitrary display cells that are arranged in two rows and two columns in the arrangement focused on only the third type of display cells in FIG. 16 are replaced with a fourth type of display cells having a light emitting color different from those of the first to third types of display cells. That is, in this configuration, the display panel 40 has a configuration in which two display cells which are arranged in a diagonal direction among the third type of four display cells that are arranged in two rows and two columns in the second rectangular grid are replaced with the fourth type of display cells having light emitting colors different from those of the first to third types of display cells.

Figure 20:
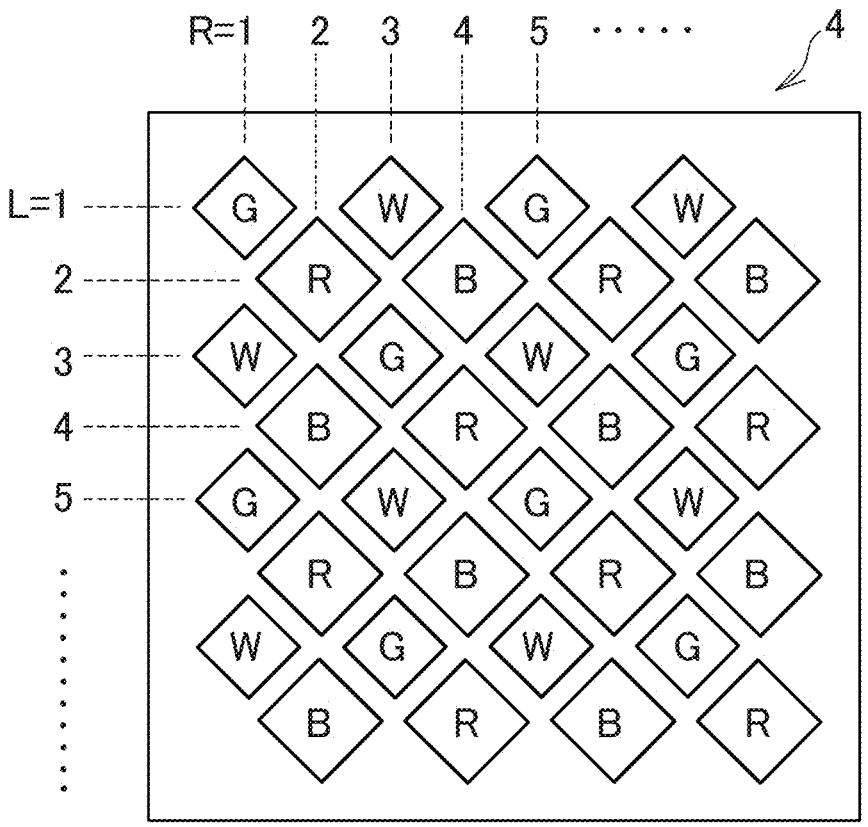
FIG. 20 is a schematic plan view illustrating an arrangement of display cells of a pixel array section according to a third modification example of the third exemplary embodiment of the invention.
Figure 21A:
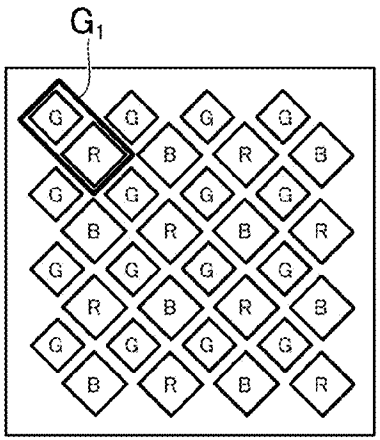
FIGS. 21A to 21D are schematic plan views of a pixel array section illustrating a display cell group according to a fourth exemplary embodiment of the invention.
Figure 21B:
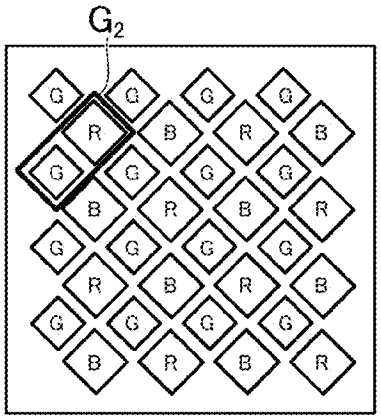
Figure 21C:
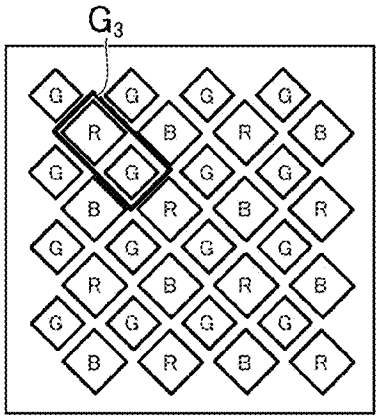
Figure 21D:
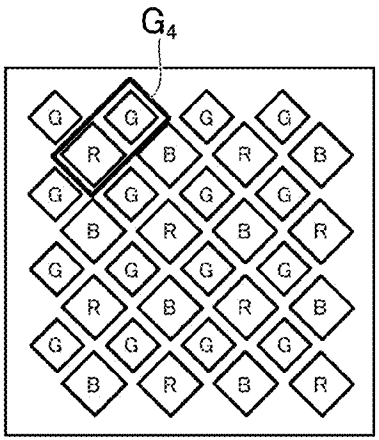

FIG. 20 is a schematic plan view of the pixel array section 4 in this configuration, and shows an arrangement of plural types of display cells having different light emitting colors. Here, a part of the G sub-pixels corresponding to the third type of display cells is replaced with a W sub-pixel corresponding to the fourth type of display cell. In the configuration shown in FIG. 20, sub-pixels S(4n−1, 4m−3) and S(4n−3, 4m−1) correspond to the W sub-pixels.

A video signal with respect to a display cell group including the W sub-pixel is generated by conversion from the RGB signal to the RGBW signal, as described in the first exemplary embodiment.

Further, the display cell groups $G_1$ to $G_4$ may include the 4×2 configuration described in the first modification example of the third exemplary embodiment, instead of the 4×4 configuration described in the third exemplary embodiment.

Fourth Exemplary Embodiment

With respect to an organic EL display device 2 according to a fourth exemplary embodiment, the same reference numerals are given to the same components as in the above-described exemplary embodiments, and basic description thereof will not be repeated. Hereinafter, different points from the respective exemplary embodiments will be mainly described.

A pixel array section 4 in the present exemplary embodiment is the same as that of the third exemplary embodiment, and has an arrangement of the display cells shown in FIG. 16.

A control unit 26 decomposes an original image into four sub-sampling images 202*a* to 202*d*, similar to the first to third exemplary embodiments. FIGS. 21A to 21D are schematic plan views of the pixel array section 4 indicating display cell groups corresponding to pixels of the respective sub-sampling images. FIGS. 21A to 21D show display cell groups $G_1$ to $G_4$ corresponding to pixels of the first, second, third, and fourth sub-sampling images 202*a* to 202*d*, respectively.

Each of the display cell groups $G_1$ to $G_4$ is a pair of display cells that includes a display cell (central display cell) disposed on a grid point of a first rectangular grid and a display cell (selective display cell) disposed on any one of four grid points of the second rectangular grid in the vicinity of the central display cell. Here, with respect to the display cell group $G_1$(2n−1, 2m−1) corresponding to the pixels P(2n−1, 2m−1) of the first sub-sampling image 202*a*, a relative position of the selective display cell with respect to the central display cell is reversed in the column direction in the display cell group $G_2$(2n, 2m−1) corresponding to the pixels P(2n, 2m−1) of the second sub-sampling image 202*b*, is reversed in the row direction and the column direction in the display cell group $G_3$(2n, 2m) corresponding to the pixels P(2n, 2m) of the third sub-sampling image 202*c*, and is reversed in the row direction in the display cell group $G_4$(2n−1, 2m) corresponding to the pixels P(2n−1, 2m) of the fourth sub-sampling image 202*d*.

For example, the display cell groups $G_1$(2n−1, 2m−1), $G_2$(2n, 2m−1), $G_3$(2n, 2m), and $G_4$(2n−1, 2m) share the sub-pixel S(2n, 2m) as the central display cell. Further, as the selective display cell, the display cell group $G_1$(2n−1, 2m−1) includes S(2n−1, 2m−1), the display cell group $G_2$(2n, 2m−1) includes the sub-pixel S(2n+1, 2m−1), the display cell group $G_3$(2n, 2m) includes the sub-pixel S(2n+1, 2m+1), and the display cell group $G_4$(2n−1, 2m) includes the sub-pixel S(2n−1, 2m+1), respectively.

In the present exemplary embodiment, similarly, the resolution is improved by overlapping the display cell groups. Further, the same effects as in the first exemplary embodiment are obtained by the rotational driving.

The G sub-pixel may be set as the central display cell, and the R sub-pixel and the B sub-pixel around the G sub-pixel may be set as the selective display cell.

First Modification Example of the Fourth Exemplary Embodiment

The fourth exemplary embodiment may also be applied to the pixel array section 4 having the arrangement of the display cells shown in FIG. 19.

Second Modification Example of the Fourth Exemplary Embodiment

The fourth exemplary embodiment may also be applied to the pixel array section 4 having the arrangement of the display cells shown in FIG. 20.

Fifth Exemplary Embodiment

With respect to an organic EL display device 2 according to a fifth exemplary embodiment, the same reference numerals are given to the same components as in the above-described exemplary embodiments, and basic description thereof will not be repeated. Hereinafter, different points from the above-described exemplary embodiments will be mainly described.

Figure 22:
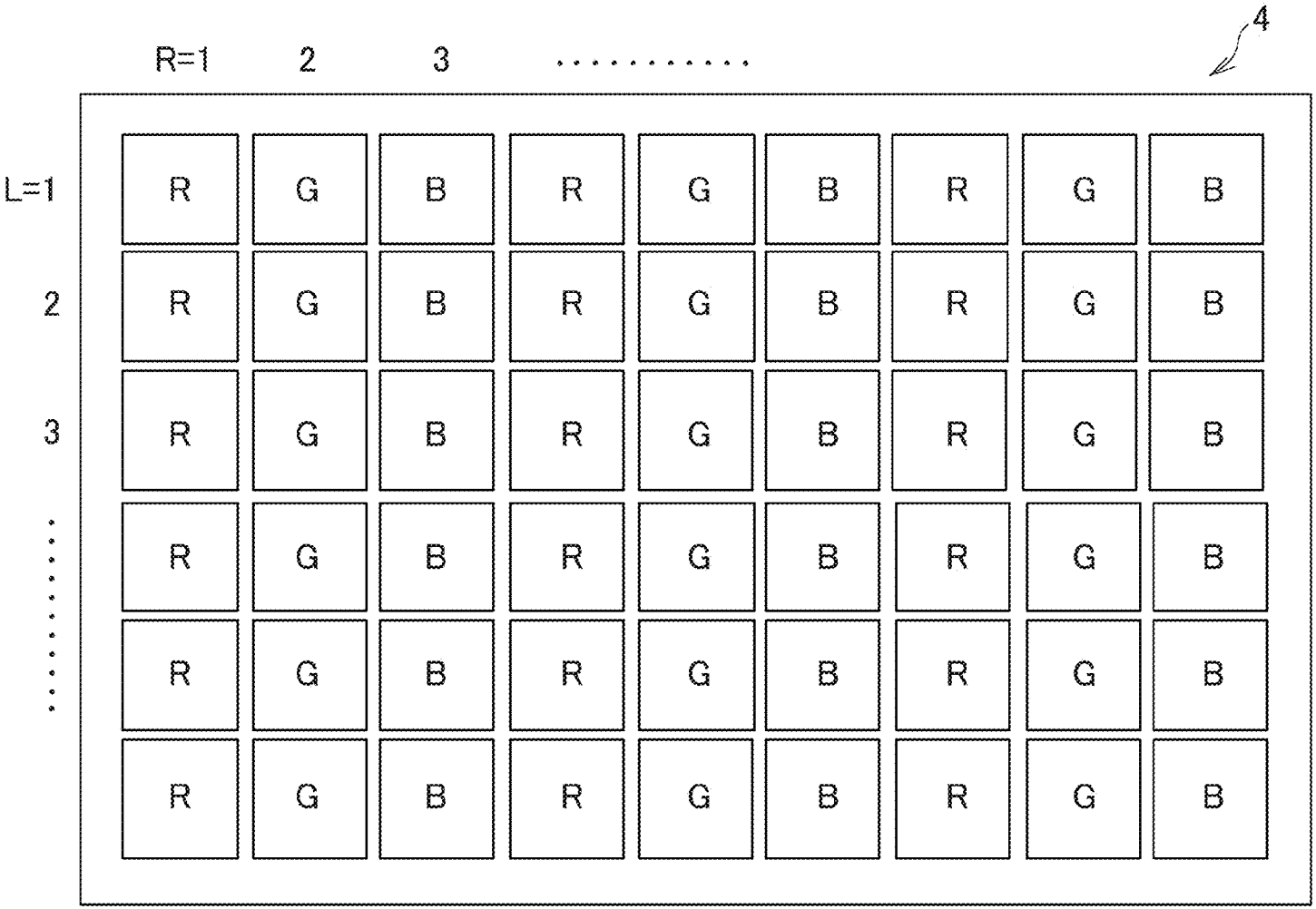
FIG. 22 is a schematic plan view illustrating an arrangement of display cells of a pixel array section according to a fifth exemplary embodiment of the invention.
Figure 23A:
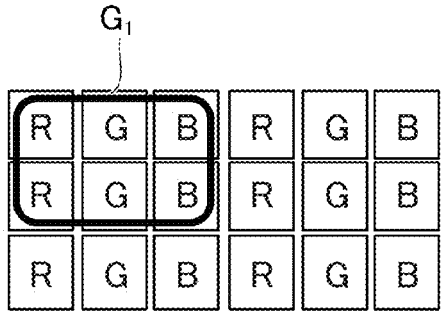
FIGS. 23A to 23F are schematic plan views of a pixel array section illustrating a display cell group according to the fifth exemplary embodiment of the invention.
Figure 23B:
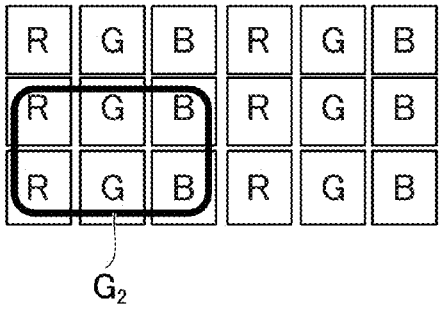
Figure 23C:
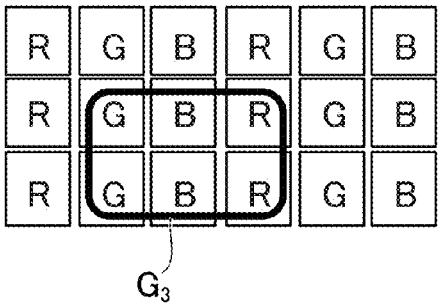
Figure 23D:
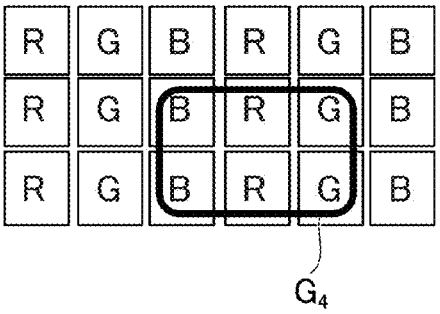
Figure 23E:
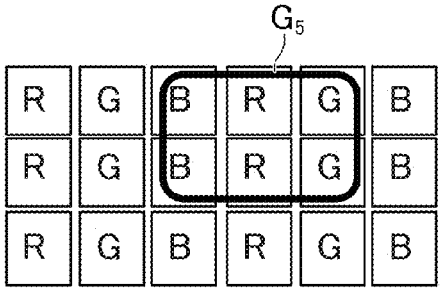
Figure 23F:
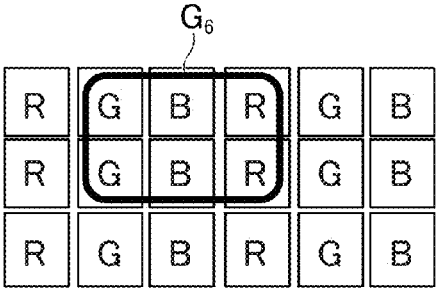

FIG. 22 is a schematic plan view of a pixel array section 4 according to a fifth exemplary embodiment, and shows an arrangement of plural types of display cells having different light emitting colors. A display panel 40 of the present exemplary embodiment has a stripe arrangement in which three types of display cells having different light emitting colors are periodically arranged in the row direction and the same type of display cells are arranged in the column direction. Specifically, in the pixel array section 4 shown in FIG. 22, an R sub-pixel, a G sub-pixel, and a B sub-pixel are arranged as the first, second, and third types of display cells.

In the present exemplary embodiment, the control unit 26 decomposes an original image 200 into six sub-sampling images of a first sub-sampling image including pixels P(2n−1, 3m−2) of a (2n−1)-th row and a (3m−2)-th column, a second sub-sampling image including pixels P(2n, 3m−2) of a 2n-th row and the (3m−2)-th column, a third sub-sampling image including pixels P(2n, 3m−1) of the 2n-th row and a (3m−1)-th column, a fourth sub-sampling image including pixels P(2n, 3m) of the 2n-th row and a 3m-th column, a fifth sub-sampling image including pixels P(2n−1, 3m) of the (2n−1)-th row and the 3m-th column, and a sixth sub-sampling image including pixels P(2n−1, 3m−1) of the (2n−1)-th row and the (3m−1)-th column. On the other hand, the control unit 26 divides one field period into six sub-field periods, and displays the sub-sampling images one by one in each sub-field period. Thus, the six sub-sampling images are sequentially displayed on the display panel 40 in one field period, and one frame original image obtained by combining the six sub-sampling images is displayed in each field period.

FIGS. 23A to 23F are schematic plan views of the pixel array section 4 illustrating display cell groups according to pixels of respective sub-sampling images. FIGS. 23A to 23F show display cell groups $G_1$ to $G_6$ corresponding to pixels of first to sixth sub-sampling images, respectively.

Each of the display cell groups $G_1$ to $G_6$ includes six display cells that are arranged in two rows and three columns. The display cell group $G_2$(2n, 3m−2) corresponding to the pixels P(2n, 3m−2) of the second sub-sampling image is shifted by one cell in the column direction with respect to the display cell group $G_1$(2n−1, 3m−2) corresponding to the pixels P(2n−1, 3m−2) of the first sub-sampling image. Further, the display cell group $G_3$(2n, 3m−1) corresponding to the pixels P(2n, 3m−1) of the third sub-sampling image is shifted by one cell in the column direction where a column number increases in the original image with respect to the display cell group $G_2$(2n, 3m−2), and the display cell group $G_4$(2n, 3m) corresponding to the pixels P(2n, 3m) of the fourth sub-sampling image is shifted by two cells in the column direction where the column number increases with respect to the display cell group $G_2$(2n, 3m−2). The display cell group $G_5$(2n−1, 3m) corresponding to the pixels P(2n−1, 3m) of the fifth sub-sampling image is shifted by two cells in the column direction where the column number increases with respect to the display cell group $G_1$(2n−1, 3m−2), and the display cell group $G_6$(2n−1, 3m−1) corresponding to the pixels P(2n−1, 3m−1) of the sixth sub-sampling image is shifted by one cell in the column direction where the column number increases with respect to the display cell group $G_1$(2n−1, 3m−2).

The pixels of the first, sixth and fifth sub-sampling images are arranged at equal intervals in the row direction, and similarly, the pixels of the second, third and fourth sub-sampling images are arranged at equal intervals in the row direction. In accordance with this arrangement, it is preferable that the positions of $G_1$(2n−1, 3m−2), $G_6$(2n−1, 3m−1), and $G_5$(2n−1, 3m) are shifted at equal intervals in the row direction. Similarly, it is preferable that the positions of $G_2$(2n, 3m−2), $G_3$(2n, 3m−1), and $G_4$(2n, 3m) are shifted at equal intervals in the row direction. In this regard, in the layout of the display cells shown in FIG. 22, an arrangement pitch of the display cells in the row direction is an equal interval, and the positions of the display cell groups in the row direction are also shifted at equal intervals.

In the present exemplary embodiment, similarly, the resolution is improved by overlapping the display cell groups. Further, the same effects as in the first exemplary embodiment are obtained by the rotational driving.

Sixth Exemplary Embodiment

With respect to an organic EL display device 2 according to a sixth exemplary embodiment, the same reference numerals are given to the same components as in the above-described exemplary embodiments, and basic description thereof will not be repeated. Hereinafter, different points from the above-described exemplary embodiments will be mainly described.

A display panel 40 of the present exemplary embodiment has a stripe arrangement of RGB sub-pixels, similar to the fifth exemplary embodiment. In the fifth exemplary embodiment, the original image is divided into six sub-sampling images to set the display cell groups $G_1$ to $G_6$, but in the present exemplary embodiment, the original image is divided into four sub-sampling images, similar to the first exemplary embodiment, to set display cell groups $G_1$ to $G_4$ corresponding to the respective sub-sampling images.

Figure 24:
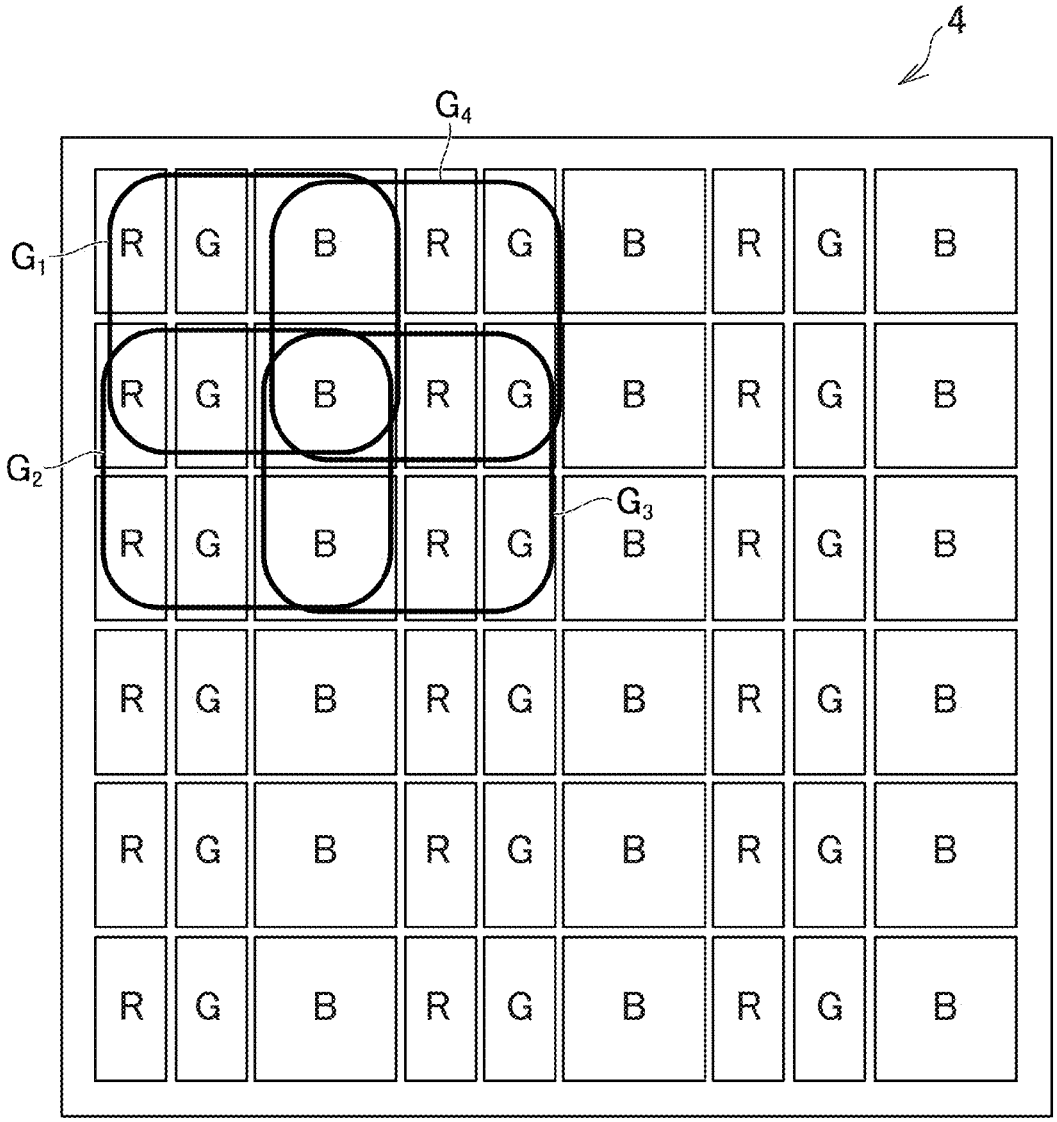
FIG. 24 is a schematic plan view illustrating a layout of a pixel array section, and a display cell group corresponding to pixels of respective sub-sampling images, according to a sixth exemplary embodiment of the invention.

FIG. 24 is a schematic plan view illustrating a layout of a pixel array section 4, and a display cell group corresponding to pixels of respective sub-sampling images, according to the present exemplary embodiment. Here, in the pixel array section 4 shown in FIG. 24, the width of the B sub-pixel is about two times the R sub-pixel and the G sub-pixel, and an arrangement pitch ratio of the R sub-pixel, the G sub-pixel, and the B sub-pixel in the row direction is about 1:1:2. Further, FIG. 24 shows display cell groups $G_1$ to $G_4$ corresponding to pixels of first to fourth sub-sampling images, respectively.

Similar to the fifth exemplary embodiment, each of the display cell groups $G_1$ to $G_4$ includes six display cells that are arranged in two rows and three columns. With respect to the display cell group $G_1$(2n−1, 2m−1) corresponding to the pixels P(2n−1, 2m−1) of the first sub-sampling image 202*a*, the display cell group $G_2$(2n, 2m−1) corresponding to the pixels P(2n, 2m−1) of the second sub-sampling image 202*b* is shifted by one cell in the column direction, the display cell group $G_3$(2n, 2m) corresponding to the pixels P(2n, 2m) of the third sub-sampling image 202*c* is shifted by one cell in the column direction and is shifted by two cells in the row direction, and the display cell group $G_4$(2n−1, 2m) corresponding to the pixels P(2n−1, 2m) of the fourth sub-sampling image 202*d* is shifted by two cells in the row direction.

Further, the display cell group $G_3$ shown in FIG. 24 may be set to the display cell group $G_1$(2n−1, 2m−1), and with respect to this display cell group, the display cell group $G_2$(2n, 2m−1) may be set to be shifted by one cell in the column direction, the display cell group $G_3$(2n, 2m) may be set to be shifted by one cell in the column direction and by one cell in the row direction, and the display cell group $G_4$(2n−1, 2m) may be set to be shifted by one cell in the row direction.

According to any display cell group setting method described above, by setting the arrangement pitch of the RGB sub-pixels to 1:1:2, the positions of the display cell groups in the row direction are shifted at equal intervals.

Further, in the present exemplary embodiment, similarly, the resolution is improved by overlapping the display cell groups. Further, the same effects as in the first exemplary embodiment are obtained by the rotational driving.

Seventh Exemplary Embodiment

With respect to an organic EL display device 2 according to a seventh exemplary embodiment, the same reference numerals are given to the same components as in the above-described exemplary embodiments, and basic description thereof will not be repeated. Hereinafter, different points from the above-described exemplary embodiments will be mainly described.

Figure 25:
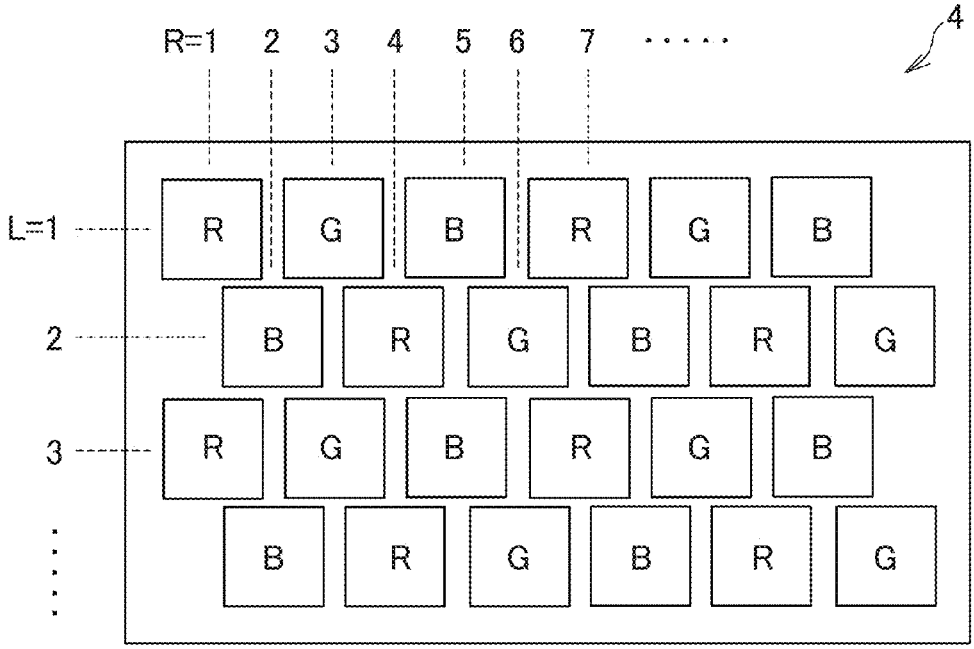
FIG. 25 is a schematic plan view illustrating an arrangement of display cells of a pixel array section according to a seventh exemplary embodiment of the invention.
Figure 26A:
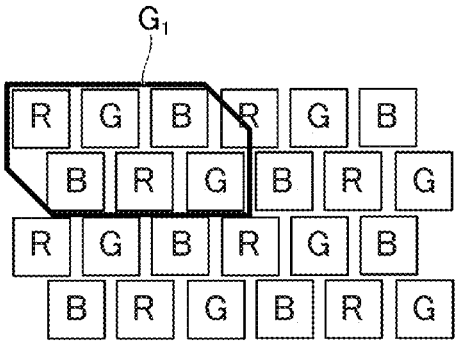
FIGS. 26A to 26D are schematic plan views of a pixel array section illustrating a display cell group according to the seventh exemplary embodiment of the invention.
Figure 26C:
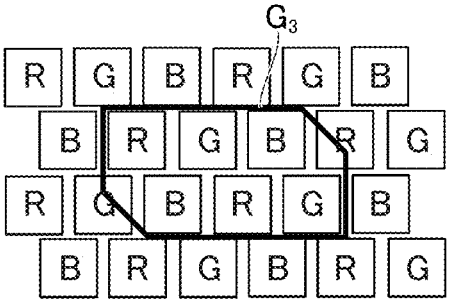
Figure 26B:
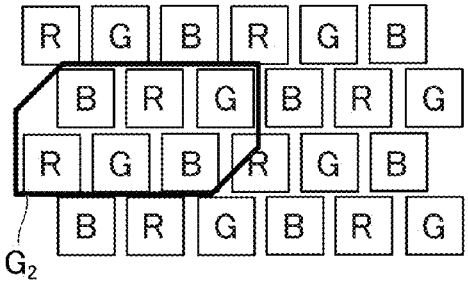
Figure 26D:
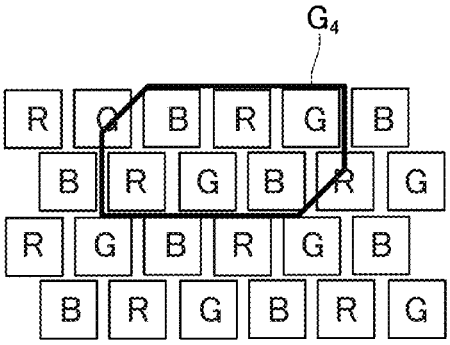

FIG. 25 is a schematic plan view of a pixel array section 4 according to the seventh exemplary embodiment, and shows an arrangement of plural types of display cells having different light emitting colors. A display panel 40 of the present exemplary embodiment has a delta arrangement in which positions of display cells arranged in the row direction are shifted between an odd row and an even row and first to third types of display cells having different light emitting colors are periodically arranged in a staggered arrangement in the odd row and the even row which are adjacent to each other. Specifically, in the pixel array section 4 shown in FIG. 25, an R sub-pixel, a B sub-pixel, and a G sub-pixel are arranged as the first, second, and third types of display cells.

The control unit 26 decomposes an original image into four sub-sampling images 202*a* to 202*d*, similar to the first exemplary embodiment. FIGS. 26A to 26D are schematic plan views of the pixel array section 4 indicating display cell groups corresponding to pixels of the respective sub-sampling images. FIGS. 26A to 26D show display cell groups $G_1$ to $G_4$ corresponding to pixels of the first, second, third, and fourth sub-sampling images 202*a* to 202*d*, respectively.

Each of the display cell groups $G_1$ to $G_4$ includes six display cells of which positions in the row direction are continuous in a staggered arrangement in two adjacent rows. When the display cell group $G_1$(2n−1, 2m−1) corresponding to the pixels P(2n−1, 2m−1) of the first sub-sampling image 202*a* is set to a (6j−5)-th display cell to a 6j-th display cell (j is a natural number) in the row direction in the staggered arrangement in an (2k−1)-th row and a 2k-th row (k is a natural number), the display cell group $G_2$(2n, 2m−1) corresponding to the pixels P(2n, 2m−1) of the second sub-sampling image 202*b* includes a (6j−5)-th display cell to a 6j-th display cell in the row direction in the staggered arrangement in the 2k-th row and a (2k+1)-th row, the display cell group $G_3$(2n, 2m) corresponding to the pixels P(2n, 2m) of the third sub-sampling image 202*c* includes a (6j−2)-th display cell to a (6j+3)-th display cell in the row direction in the staggered arrangement in the 2k-th row and the (2k+1)-th row, and the display cell group $G_4$(2n−1, 2m) corresponding to the pixels P(2n−1, 2m) of the fourth sub-sampling image 202*d* includes a (6j−2)-th display cell to a (6j+3)-th display cell in the row direction in the staggered arrangement in the (2k−1)-th row and the 2k-th row.

Further, in the present exemplary embodiment, similarly, the resolution is improved by overlapping the display cell groups. Further, the same effects as in the first exemplary embodiment are obtained by the rotational driving.

Figure 27:
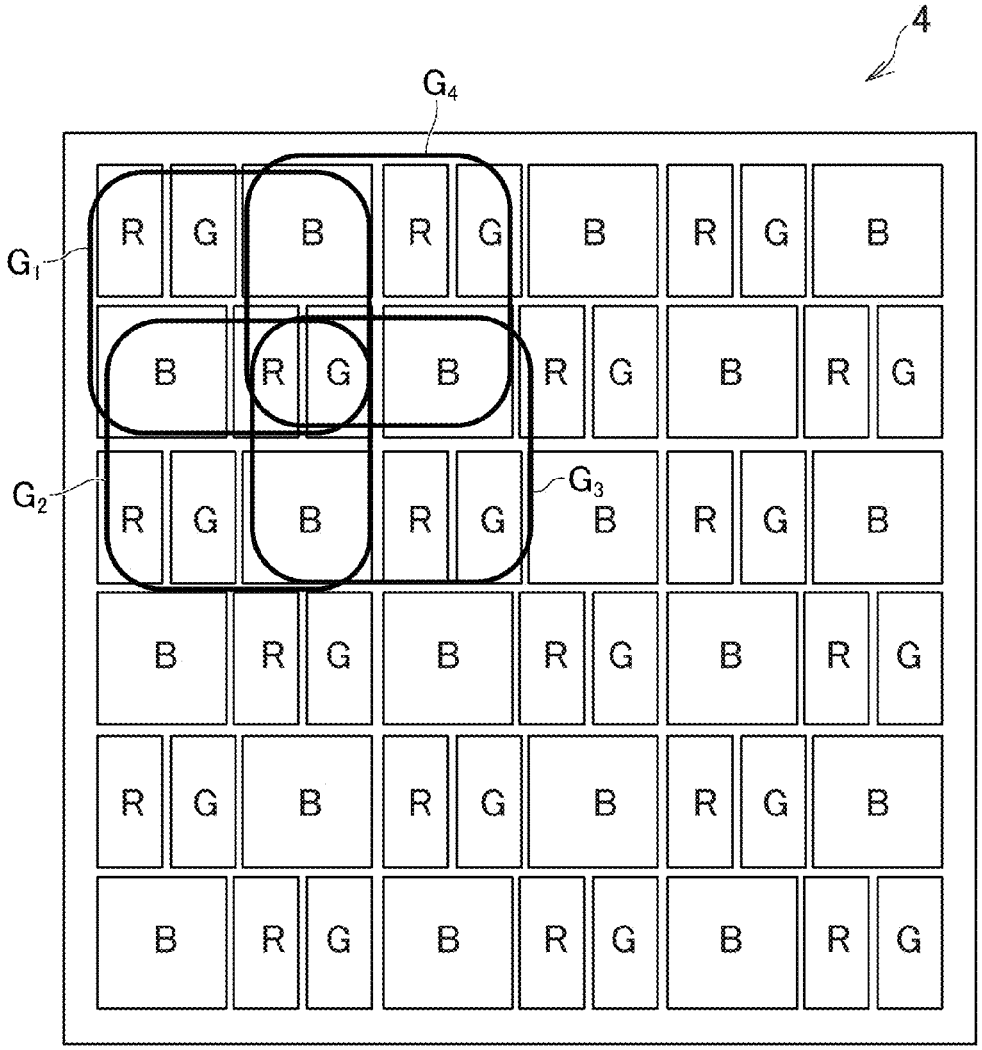
FIG. 27 is a schematic plan view illustrating another layout of a pixel array section, and a display cell group corresponding to pixels of respective sub-sampling images, according to the seventh exemplary embodiment of the invention.
Figure 28A:
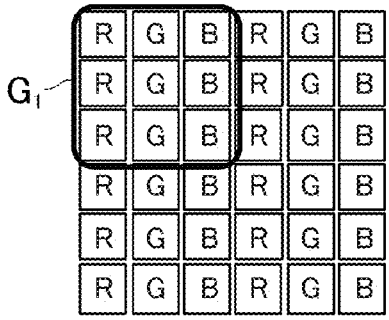
FIGS. 28A to 28I are schematic plan views illustrating another layout of a pixel array section, and a display cell group corresponding to pixels of respective sub-sampling images, according to an eighth exemplary embodiment of the invention.
Figure 28B:
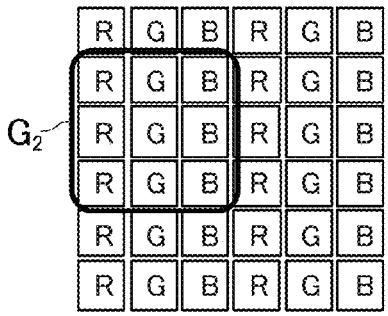
Figure 28C:
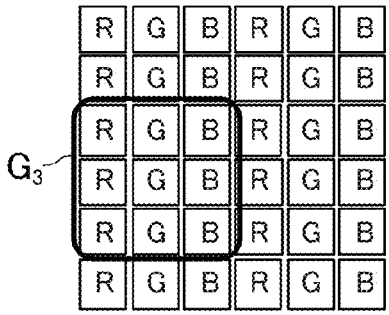
Figure 28D:
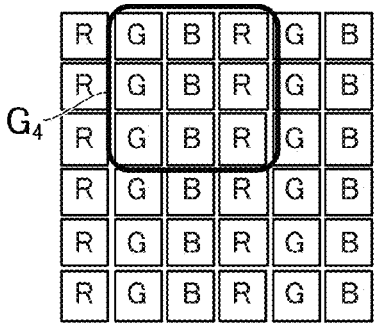
Figure 28E:
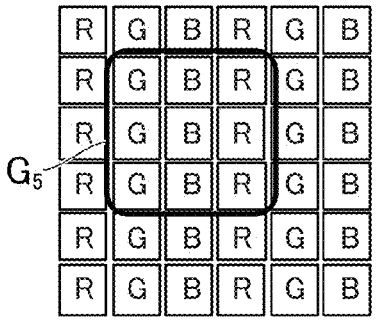
Figure 28F:
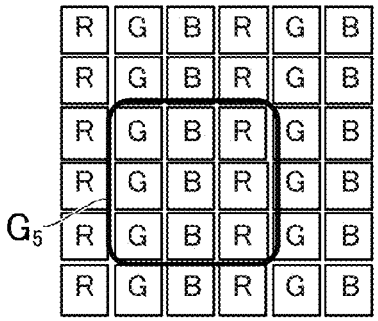
Figure 28G:
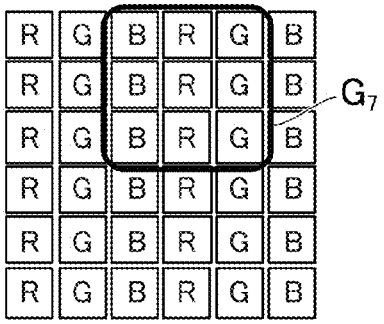
Figure 28H:
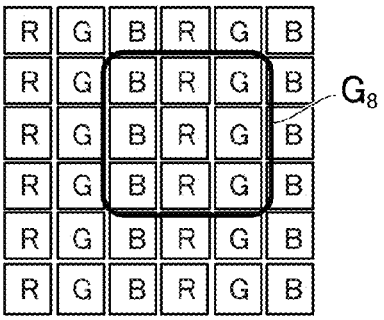
Figure 28I:
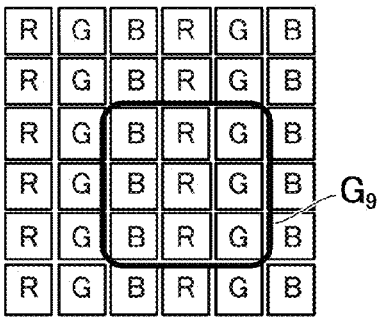

FIG. 27 is a schematic plan view illustrating another layout of a pixel array section 4, and a display cell group corresponding to pixels of respective sub-sampling images, according to the present exemplary embodiment. The layout of the display cells shown in FIG. 27 is different from the layout of the display cells shown in FIG. 25, but since positions (for example, central positions) of respective display cells are arranged in a staggered arrangement in the row direction, the pixel array section 4 forms a delta arrangement. FIG. 27 shows display cell groups $G_1$ to $G_4$. The display cell groups $G_1$ to $G_4$ are basically the same as in FIGS. 26A to 26D.

In the present exemplary embodiment, similarly, the resolution is improved by overlapping the display cell groups. Further, the same effects as in the first exemplary embodiment are obtained by the rotational driving.

Modification Example of the Seventh Exemplary Embodiment

In the arrangement of the display cells shown in FIG. 25 or 27, each of the display cell groups $G_1$ to $G_4$ includes three display cells of which positions in the row direction are continuous in a staggered arrangement in two adjacent rows. Specifically, when the display cell group $G_1$(2n−1, 2m−1) is set to a (3j−2)-th display cell to a 3j-th display cell in the row direction in the staggered arrangement in a (2k−1)-th row and a 2k-th row, the display cell group $G_2$(2n, 2m−1) includes a (3j−2)-th display cell to a 3j-th display cell in the row direction in the staggered arrangement in the 2k-th row and a (2k+1)-th row, the display cell group $G_3$(2n, 2m) includes a (3j−1)-th display cell to a (3j+1)-th display cell in the row direction in the staggered arrangement in the 2k-th row and the (2k+1)-th row, and the display cell group $G_4$(2n−1, 2m) corresponding to the pixels P(2n−1, 2m) of the fourth sub-sampling image 202*d* includes a (3j−1)-th display cell to a (3j+1)-th display cell in the row direction in the staggered arrangement in the (2k−1)-th row and the 2k-th row.

Further, similar to the fifth exemplary embodiment, a configuration in which the original image is divided into six sub-sampling images to set display cell groups $G_1$ to $G_6$ may be used. In this configuration, when the display cell group $G_1$(2n−1, 3m−2) is set to a (3j−2)-th display cell to a 3j-th display cell in the row direction in the staggered arrangement in a (2k−1)-th row and a 2k-th row, the display cell group $G_2$(2n, 3m−2) includes a (3j−2)-th display cell to a 3j-th display cell in the row direction in the staggered arrangement in the 2k-th row and a (2k+1)-th row. In addition, the display cell group $G_3$(2n, 3m−1) includes a (3j−1)-th display cell to a (3j+1)-th display cell in the row direction in the staggered arrangement in the 2k-th row and the (2k+1)-th row, and the display cell group $G_4$(2n, 3m) includes a 3j-th display cell to a (3j+2)-th display cell in the row direction in the staggered arrangement in the 2k-th row and the (2k+1)-th row. The display cell group $G_5$(2n−1, 3m) includes a 3j-th display cell to a (3j+2)-th display cell in the row direction in the staggered arrangement in the (2k−1)-th row and the 2k-th row, and the display cell group $G_6$(2n−1, 3m−1) includes a (3j−1)-th display cell to a (3j+1)-th display cell in the row direction in the staggered arrangement in the (2k−1)-th row and the 2k-th row.

Eighth Exemplary Embodiment

With respect to an organic EL display device 2 according to an eighth exemplary embodiment, the same reference numerals are given to the same components as in the above-described exemplary embodiments, and basic description thereof will not be repeated. Hereinafter, different points from the above-described exemplary embodiments will be mainly described.

A display panel 40 of the present exemplary embodiment has a stripe arrangement of RGB sub-pixels, similar to the fifth exemplary embodiment. In the fifth exemplary embodiment, the original image is divided into six sub-sampling images to set the display cell groups $G_1$ to $G_6$, but in the present exemplary embodiment, the original image is divided into nine sub-sampling images to set display cell groups $G_1$ to $G_9$.

The control unit 26 decomposes an original image 200 into nine sub-sampling images of a first sub-sampling image including pixels P(3n−2, 3m−2), a second sub-sampling image including pixels P(3n−1, 3m−2), a third sub-sampling image including pixels Ps(3n, 3m−2), a fourth sub-sampling image including pixels P(3n−2, 3m−1), a fifth sub-sampling image including pixels P(3n−1, 3m−1), a sixth sub-sampling image including pixels P(3n, 3m−1), a seventh sub-sampling image including pixels P(3n−2, 3m), an eighth sub-sampling image including pixels P(3n−1, 3m), and a ninth sub-sampling image including pixels P(3n, 3m).

FIGS. 28A to 28I are schematic plan views illustrating a layout of a pixel array section 4, and a display cell group corresponding to pixels of respective sub-sampling images, according to the present exemplary embodiment. FIGS. 28A to 28I show display cell groups $G_1$ to $G_9$ corresponding to pixels of first to ninth sub-sampling images, respectively.

Each of the display cell groups $G_1$ to $G_9$ includes nine display cells that are arranged in three rows and three columns. With respect to the display cell group $G_1$(3n−2, 3m−2) corresponding to the pixels P(3n−2, 3m−2) of the first sub-sampling image, the display cell group $G_2$(3n−1, 3m−2) corresponding to the pixels P(3n−1, 3m−2) of the second sub-sampling image is shifted by one cell in the column direction, and the display cell group $G_3$(3n, 3m−2) corresponding to the pixels P(3n, 3m−2) of the third sub-sampling image is shifted by two cells in the column direction. Further, with respect to the display cell group $G_1$(3n−2, 3m−2), the display cell group $G_4$(3n−2, 3m−1) corresponding to the pixels P(3n−2, 3m−1) of the fourth sub-sampling image is shifted by one cell in the row direction, and the display cell group $G_7$(3n−2, 3m) corresponding to the pixels P(3n−2, 3m) of the seventh sub-sampling image is shifted by two cells in the row direction. With respect to the display cell group $G_2$(3n−1, 3m−2), the display cell group $G_5$(3n−1, 3m−1) corresponding to the pixels P(3n−1, 3m−1) of the fifth sub-sampling image is shifted by one cell in the row direction, and the display cell group $G_8$(3n−1, 3m) corresponding to the pixels P(3n−1, 3m) of the eighth sub-sampling image is shifted by two cells in the row direction. With respect to the display cell group $G_3(3n, 3m-2)$, the display cell group $G_3(3n, 3m-1)$ corresponding to the pixels P(3n, 3m−1) of the sixth sub-sampling image is shifted by one cell in the row direction, and the display cell group $G_9(3n, 3m)$ corresponding to the pixels P(3n, 3m) of the ninth sub-sampling image is shifted by two cells in the row direction.

In the present exemplary embodiment, similarly, the resolution is improved by overlapping the display cell groups.

In the respective exemplary embodiments, an example in which the organic EL display device is used as a disclosure example of the display device is described, but a so-called flat panel type display device such as a liquid crystal display device, a self light emitting display device, or an electronic paper type display device including an electrophoretic element or the like may be used as another application example. Further, the display device is not limited to a specific size, and may have a small, medium or large size.

It is understood that various modifications and revisions can be made by those skilled in the art in a range without departing from the category of the invention, and that such modifications and revisions are included in the scope of the invention. For example, in the above-described exemplary embodiments, appropriate additions, omissions or design changes of components, or appropriate additions, omissions or condition changes of processes by those skilled in the art are also included in the scope of the invention as long as they include the spirit of the invention.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device comprising:

a display panel in which display cells capable of being independently driven are two-dimensionally arranged; and a drive circuit that decomposes an original image that includes a plurality of pixels into a plurality of sub-sampling images that includes the pixels which are respectively intermittent in a row direction and a column direction, and sequentially displays the plurality of sub-sampling images on the display panel, wherein the drive circuit drives a display cell group including a plurality of display cells that are two-dimensionally arranged to be adjacent to each other, corresponding to the respective pixels, the display cell group corresponding to an arbitrary attention pixel in one sub-sampling image among two arbitrary sub-sampling images that form one original image, and the display cell group corresponding to a pixel adjacent to the attention pixel in the other sub-sampling image are overlapped and are disposed to be mutually shifted, the display panel has three types of display cells having different light emitting colors, in which grid points of a first rectangular grid correspond to positions of the display cells in the even rows and positions of the display cells in the even columns, grid points of a second rectangular grid that is shifted in the row direction and the column direction with respect to the first rectangular grid correspond to positions of the display cells in the odd rows and positions of the display cells in the odd columns, first and second types of display cells are alternately arranged in the row direction and the column direction at the grid points of the first rectangular grid, and a third type of display cell is arranged in each grid point of the second rectangular grid, the drive circuit decomposes the original image into four sub-sampling images of a first sub-sampling image that includes the pixels in the odd rows and the odd columns, a second sub-sampling image that includes the pixels in the even rows and the odd columns, a third sub-sampling image that includes the pixels in the even rows and the even columns, and a fourth sub-sampling image that includes the pixels in the odd rows and the even columns, and the display cell group includes four display cells that are arranged in four rows and two columns, in which with respect to the display cell groups corresponding to the pixels of the first sub-sampling image, the display cell groups corresponding to the pixels of the second sub-sampling image are shifted by two rows, the display cell groups corresponding to the pixels of the third sub-sampling image are shifted by two rows and one column, and the display cell groups corresponding to the pixels of the fourth sub-sampling image are shifted by one column.

* * * * *